US008650713B2

(12) United States Patent
Migliorini

(10) Patent No.: US 8,650,713 B2
(45) Date of Patent: Feb. 18, 2014

(54) FULLY CONCEALED HINGE WITH INTEGRATED CLOSING DEVICE FOR DOORS AND/OR OPENABLE FURNITURE PARTS

(75) Inventor: Massimo Migliorini, Rimini (IT)

(73) Assignee: Koblenz S.p.A., Coriano (IT)

( * ) Notice: Subject to any disclaimer, the term of this patent is extended or adjusted under 35 U.S.C. 154(b) by 11 days.

(21) Appl. No.: 13/596,167

(22) Filed: Aug. 28, 2012

(65) Prior Publication Data

US 2013/0067686 A1 Mar. 21, 2013

(30) Foreign Application Priority Data

Sep. 16, 2011 (EP) ..... 11425236

(51) Int. Cl.
*E05D 3/06* (2006.01)

(52) U.S. Cl.
USPC ..... 16/302; 16/298; 16/369; 16/370

(58) Field of Classification Search
USPC ..... 16/277, 278, 281, 282, 283, 286, 287, 16/288, 297, 298, 300, 302, 303, 304, 305, 16/366, 368, 369, 370, 50, 358
See application file for complete search history.

(56) References Cited

U.S. PATENT DOCUMENTS

| | | | | | |
|---|---|---|---|---|---|
| 880,697 | A | * | 3/1908 | Soss | 16/357 |
| 882,721 | A | * | 3/1908 | Soss | 16/68 |
| 1,030,936 | A | * | 7/1912 | Soss | 16/369 |
| 1,280,357 | A | * | 10/1918 | Zuckerman | 16/369 |
| 1,687,271 | A | * | 10/1928 | Soss | 16/358 |
| 1,688,996 | A | * | 10/1928 | Soss | 16/358 |
| 1,693,004 | A | * | 11/1928 | Soss | 16/358 |
| 1,698,245 | A | * | 1/1929 | Soss | 16/358 |
| 1,797,802 | A | * | 3/1931 | Soss | 16/369 |
| 1,984,092 | A | * | 12/1934 | Soss | 16/369 |
| 2,021,702 | A | * | 11/1935 | Soss | 16/369 |
| 2,040,279 | A | * | 5/1936 | Soss | 16/273 |
| 2,178,271 | A | * | 10/1939 | Soss | 16/358 |
| 2,320,772 | A | * | 6/1943 | Doman | 16/358 |
| 2,437,192 | A | * | 3/1948 | Glanz | 16/50 |
| 2,608,713 | A | * | 9/1952 | Soss | 16/337 |
| 2,709,276 | A | | 5/1955 | Pierce | |
| 3,001,224 | A | * | 9/1961 | Soss | 16/276 |

(Continued)

FOREIGN PATENT DOCUMENTS

| | | |
|---|---|---|
| DE | 42 17 640 A1 | 12/1993 |
| EP | 0 144 628 A2 | 6/1985 |

(Continued)

*Primary Examiner* — Jeffrey O Brien
(74) *Attorney, Agent, or Firm* — Pearne & Gordon LLP

(57) ABSTRACT

In a fully concealed hinge (1), a connecting device (2) joins a first and a second fastening member (1*a*;1*b*) allowing their relative mobility between open and closed position. An arm element (20) of the connecting device (2), hinged on a pin (3) of the first fastening member (1*a*), has at different positions along said pin (3) a first (5) and a second (6) cam element having corresponding active portions (52, 62) interacting with a first and a second tappet (50, 60) of the first fastening member (1*a*) in respective, at least partly not superposed, angular fields of rotation of the arm element (20). First and second elastic means (51, 61), biasing the first and second tappet (50,60) respectively, are loaded by increasing the angle of rotation in the first or second angular field, respectively, and released by decreasing said angle of rotation, thereby causing movement towards the closed position.

15 Claims, 18 Drawing Sheets

(56) References Cited

U.S. PATENT DOCUMENTS

| | | | | |
|---|---|---|---|---|
| 3,835,585 | A | 9/1974 | Anderson et al. | |
| 3,860,995 | A | 1/1975 | Lautenschlager, Jr. et al. | |
| 3,881,221 | A * | 5/1975 | Schmidt | 16/366 |
| 4,389,748 | A | 6/1983 | Grossman | |
| 4,400,848 | A | 8/1983 | Grass | |
| 4,449,269 | A | 5/1984 | Sundermeier et al. | |
| 4,724,578 | A | 2/1988 | Toyama | |
| 4,875,252 | A | 10/1989 | Falconer et al. | |
| 5,027,474 | A | 7/1991 | Bowers | |
| 6,393,664 | B1 | 5/2002 | Habegger | |
| 6,829,808 | B2 * | 12/2004 | Neukotter | 16/366 |
| 7,861,378 | B2 * | 1/2011 | Neukotter | 16/366 |
| 2003/0150083 | A1 | 8/2003 | Pan | |
| 2004/0226139 | A1 | 11/2004 | Salice | |
| 2006/0032021 | A1 | 2/2006 | Fukuo | |
| 2006/0282983 | A1 | 12/2006 | Zetti | |
| 2007/0169416 | A1 | 7/2007 | Falato et al. | |
| 2008/0276422 | A1 | 11/2008 | Beckmann et al. | |
| 2010/0199459 | A1 | 8/2010 | Bacchetti | |
| 2010/0275409 | A1 | 11/2010 | Walhorn et al. | |

FOREIGN PATENT DOCUMENTS

| | | | |
|---|---|---|---|
| EP | 0 144 639 | A2 | 6/1985 |
| EP | 0352912 | A1 | 1/1990 |
| EP | 1 640 539 | A1 | 3/2006 |
| GB | 958 156 | A | 5/1964 |
| GB | 1249 042 | A | 10/1971 |
| GB | 2 448 381 | A | 10/2008 |
| JP | H-0552181 | U | 7/1993 |
| JP | 6-288139 | A | 10/1994 |
| WO | 2009/125357 | A1 | 10/2009 |
| WO | 2010/007599 | A1 | 1/2010 |
| WO | 2011/020630 | A1 | 2/2011 |

* cited by examiner

FULLY CONCEALED HINGE WITH INTEGRATED CLOSING DEVICE FOR DOORS AND/OR OPENABLE FURNITURE PARTS

This invention relates to a fully concealed hinge with integrated closing device for doors and/or openable furniture parts.

There are various types of hinges used to connect a door separating two rooms (or the openable part of a piece of furniture) with the respective jamb in such a way that the door or openable furniture part can rotate about an ideal axis of rotation to provide access to the space on the other side of the door (or openable furniture part) itself. In recent years, fully concealed hinges (also known as "invisible hinges"), that is, hinges which are totally hidden from view on both sides of the door or openable furniture part when the door or openable furniture part is closed, have become more and more common. Generally speaking, these hinges comprise two fastening members (one to be recessed in the door or openable furniture part, for example in the outer edge of it, and the other to be recessed in the jamb) joined to each other by a connecting device—usually consisting of arms which are articulated to varying degrees—which allows them to move relative to each other between two limit positions corresponding to the open and closed positions of the door or openable furniture part. In the closed position, the two fastening members are face to face and, at the same time, the connecting device (and thus also the arms) is tucked away inside cavities made in the fastening members themselves in such a way that when the door or openable furniture part is closed, the hinge is completely hidden between the door or openable furniture part and the respective jamb.

The connecting devices joining the two fastening members may be made in several different ways, with two or more articulated arms forming linkages of various kinds, while all maintaining the feature of allowing the fastening members to be tucked away in recesses when the door is closed, an that the hinge remains invisible.

In a first example configuration of the connecting device, the articulation arms it is composed of are variously shaped and have a first end hinged to one fastening member and the other end slidable in a sliding guide made in the other fastening member. The arms are also hinged to each other between the ends to form a "five-point articulation" (three rotation pins, of which two are fixed and one is movable, plus two pins slidable in the guides). Thanks to the constraint thus obtained and to the possibility that one end of the arms can slide inside the respective fastening member, the arms can rotate relative to each other and guarantee the complex roto-translational motion necessary, in a configuration where the hinges are fully recessed and hidden from view, to allow the door or openable furniture part to open and close.

In another example configuration of the connecting device, both ends of the articulated arms it is composed of are hinged, the first to one fastening member and the second to the other fastening member. Another degree of freedom is provided by the fact that each arm is composed of at least two elements which are in turn hinged to each other at a common end. Further, the arms are also hinged to each other by a common pin located between the ends of one of the arm elements. This structure forms a "7-point articulation" (since there are 7 hinge pins between the articulation arms and between the arms and the fastening members) where the arms can rotate relative to each other and where (thanks to the constraint between each other and with the hinge parts) they can guarantee the complex roto-translational motion necessary to allow the door or openable furniture part to open and close in a configuration where the hinges are fully recessed and hidden from view. The "7-point articulation", though it requires greater complexity in the structure of the arms, makes it possible to reduce the thickness of the fastening members in that recessing them in the door or in the jamb does not require the same depth as required for the sliding guides in the solution with the "5-point articulation".

In many cases, a user will open the door or openable furniture part to gain access to the space or room on the other side and will then forget to close it. To overcome this drawback, an external auxiliary closing system is usually installed between the door and the respective jamb in order to move the door back to the closed position automatically. The external auxiliary closing system is often furnished with a brake which slows the movement of the door towards the closed position to prevent it from banging shut. The external auxiliary closing systems are, however, visible and cumbersome. The use of these external systems therefore nullifies the advantage of using fully concealed (or "invisible") hinges from both the functional and aesthetic viewpoints.

Document EP 0 352 912 A1 describes an invisible hinge of the type having a connecting device with a "five-point articulation" as described above, in which an automatic closing device is integrated. The automatic closing device is structured as follows. The end of one of the two articulated arms which slides in a runner formed in one of the two fastening members is operated on by a link rod. The link rod is spring biased by a coil spring coaxial with the selfsame link rod. The link rod and spring system protrudes from the bottom of the fastening member in whose runner the end of the arm operated on by the link rod slides. The spring is enclosed, externally of the fastening member, between the bottom of the fastening member and a stop member of the link rod itself. When the hinge is moved from the closed position towards the open position, the sliding end of the arm, as it slides in the runner, pulls the link rod along with it, causing the spring to be compressed between the bottom of the fastening member and the stop member of the link rod. When the user lets go of the door or openable furniture part, the spring returns to the extended position, urging the end of the arm, through the link rod, to slide in the direction opposite the opening direction. Imparting the sliding movement to the end of the arm in this way activates the linkage of the connecting device which moves the door or openable furniture part automatically back to the closed position.

The solution described above has several disadvantages. The space occupied by the link rod and spring system considerably increases the size of the fastening member it is associated with, making it necessary to cut a very deep recess to install the hinge fastening member in the door or jamb. The device is difficult to calibrate and tends to produce a closing movement which is either too weak or too strong, giving rise to risks also for the user. The device is applicable only to invisible hinges with a five-point articulation or, in any case, to hinges whose articulation has at least one shoe which is slidable in a runner. Further, at no point in the opening movement is the hinge not subjected to stress which tends to close it. That means that to prevent the door from closing automatically, it must be held back with considerable force for the entire angular extent of its movement.

The aim of this invention is to overcome the above mentioned disadvantages by providing a fully concealed hinge with integrated closing device for doors and/or openable furniture parts where the closing force of the closing device can be correctly modulated. Another aim of the invention is to allow the user to keep the door, at least in the fully open position, without having to hold it. Another aim of the invention is to provide the largest possible number of kinds of fully concealed hinges with the same type of closing device. A further aim of the invention is to provide a fully concealed hinge with an integrated closing device that is versatile, easy to use and easy to calibrate.

Accordingly, this invention achieves these aims and others, more apparent in the description which follows, with a fully concealed hinge with an integrated closing device for doors and/or openable furniture parts, which has the structural and functional features described in the independent claim herein, further embodiments of it being described in the dependent claims.

The invention is described in more detail below with reference to the accompanying drawings, which illustrate a preferred, non-limiting embodiment and in which.

Figure 4C:
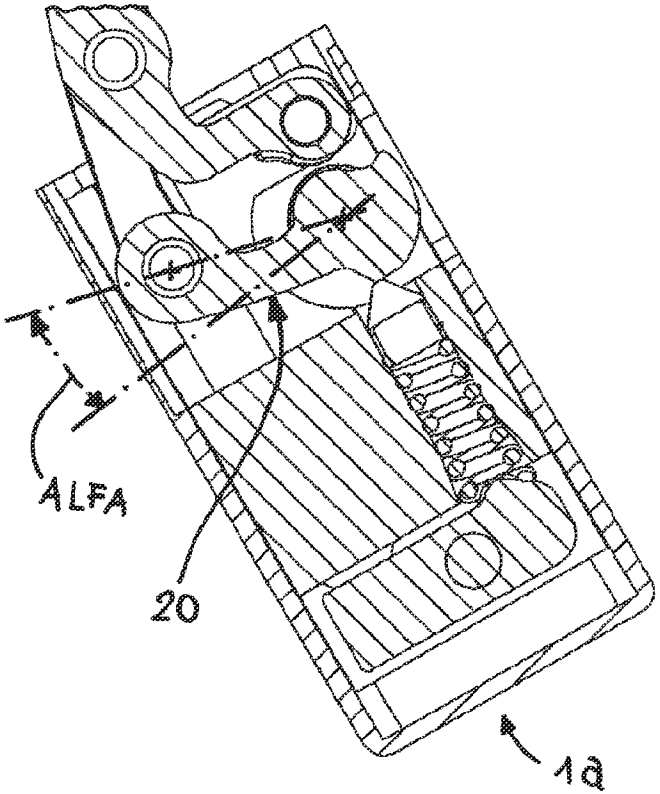
Figure 4D:
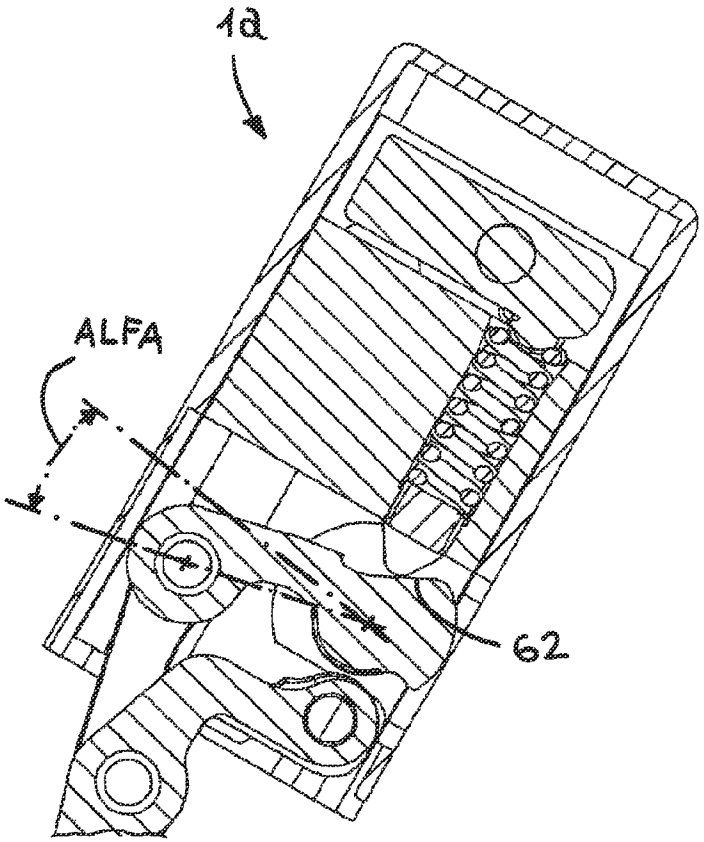
Figure 4B:
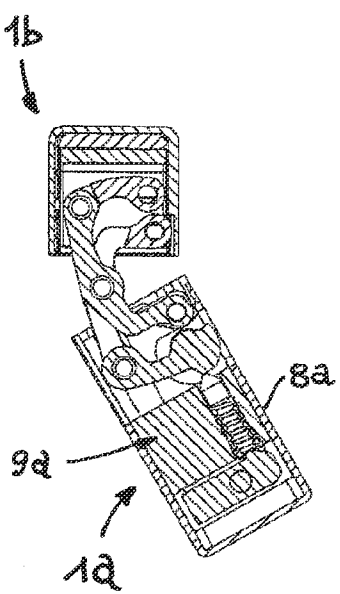
Figure 4A:
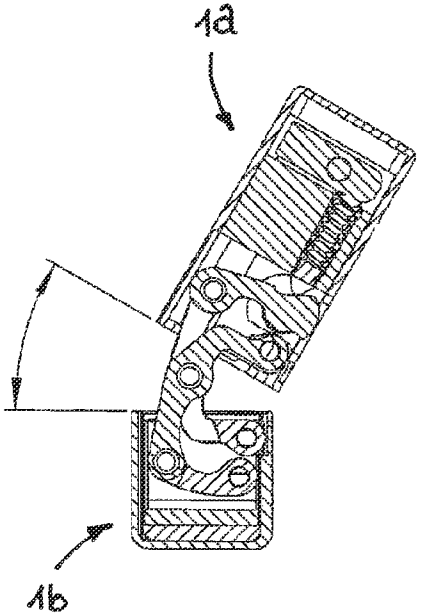
Figure 4:
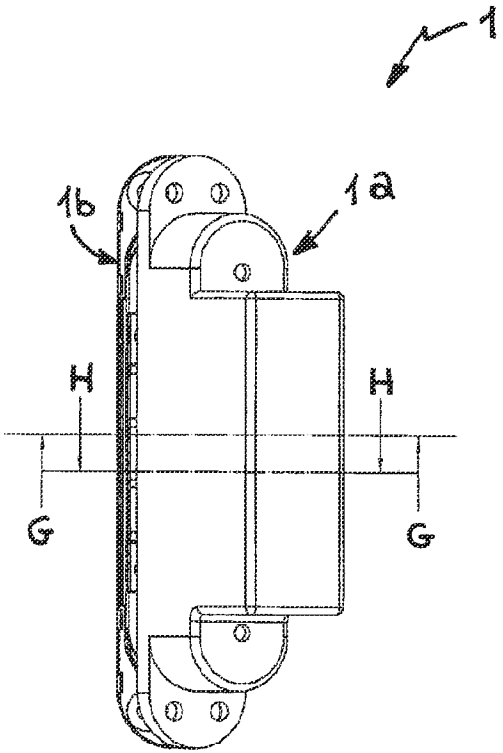
Figure 5B:
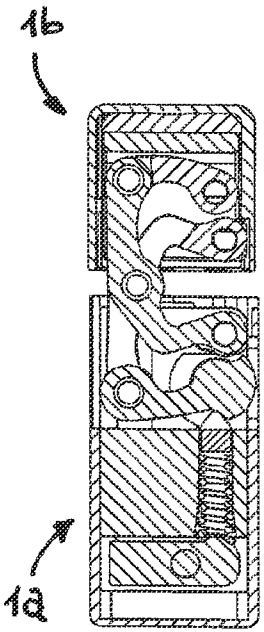
Figure 5A:
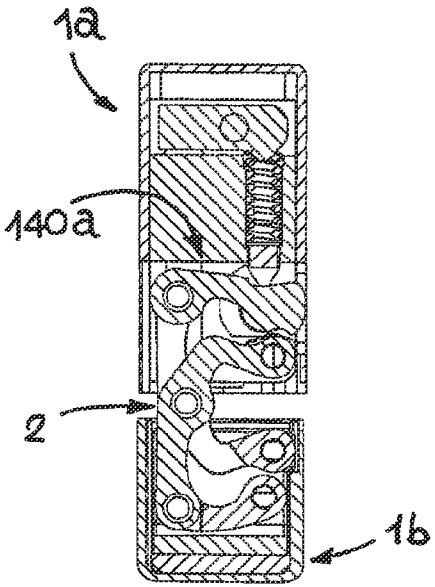
Figure 5:
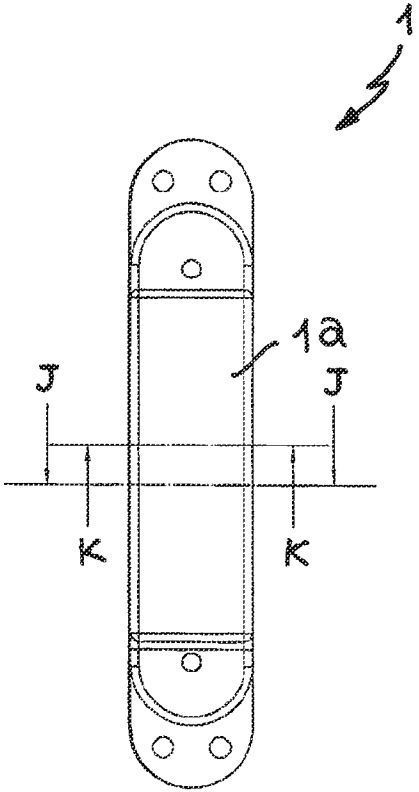

FIG. 4 is a front view of the concealed hinge of the invention in yet another partly open position, FIGS. 4*a* and 4*b* showing the cross sections of it through the planes labelled, respectively, F-F and E-E in FIG. 4, FIG. 5 is a front view of the concealed hinge of the invention in the closed position, FIGS. 5*a* and 5*b* showing the cross sections of it through the planes labelled, respectively, K-K and in FIG. 5.

Figures 1, 1A, 1B:
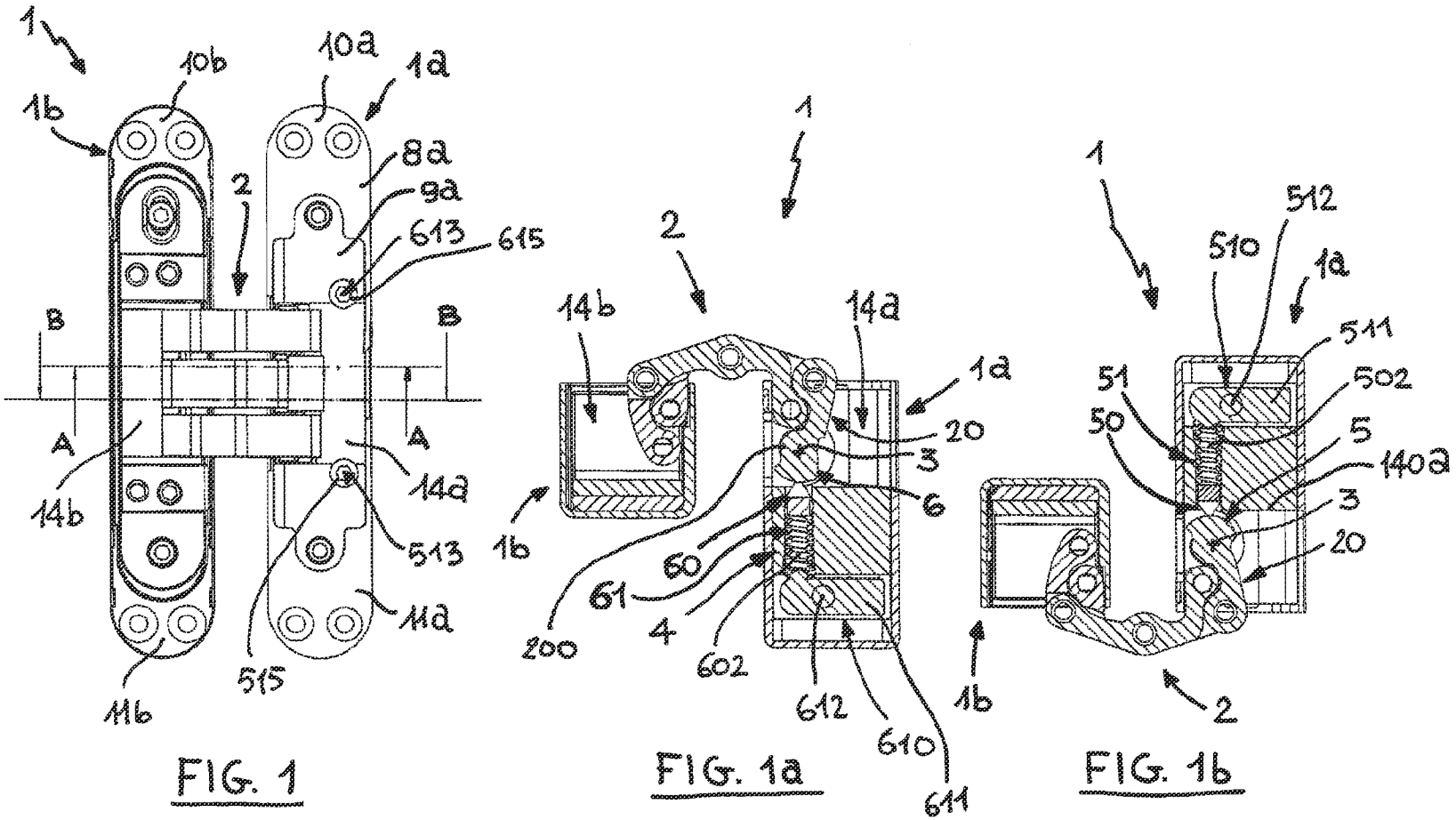
FIG. 1 is a front view of the concealed hinge of the invention in the fully open position, FIGS. 1*a* and 1*b* showing the cross sections of it through the planes labelled, respectively, A-A and B-B in FIG. 1.
Figure 2C:
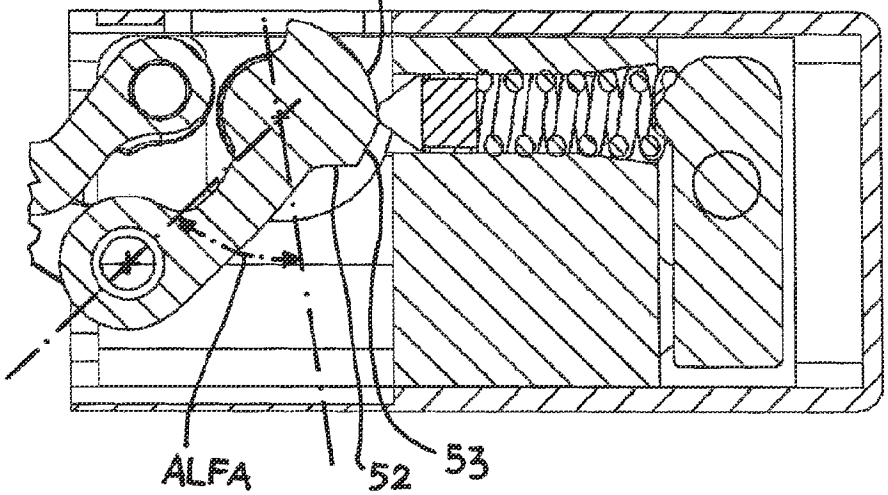
FIG. 2 is a front view of the concealed hinge of the invention in a partly open position, FIGS. 2*a* and 2*b* showing the cross sections of it through the planes labelled, respectively, D-D and C-C in FIG. 2.
Figure 1C:
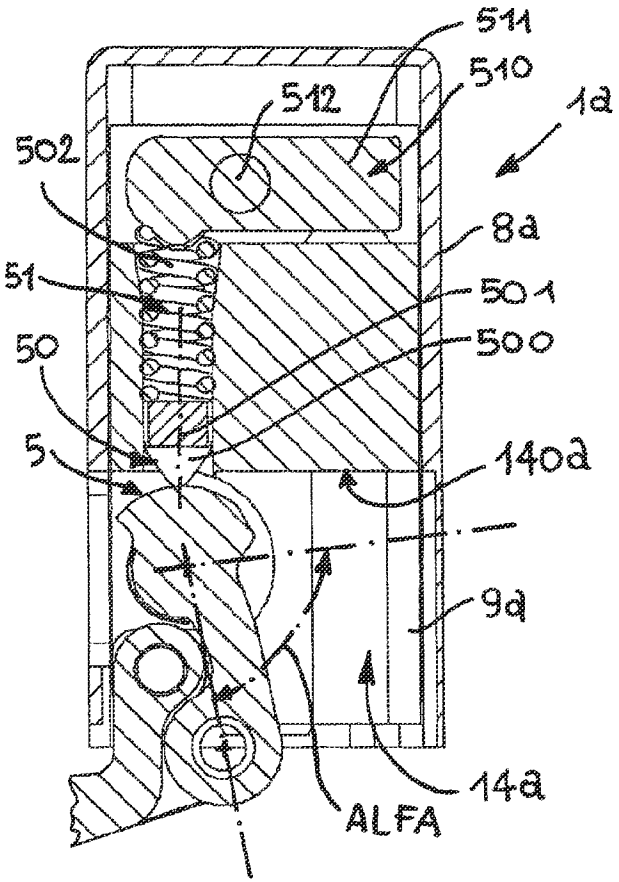
Figures 1D, 2D:
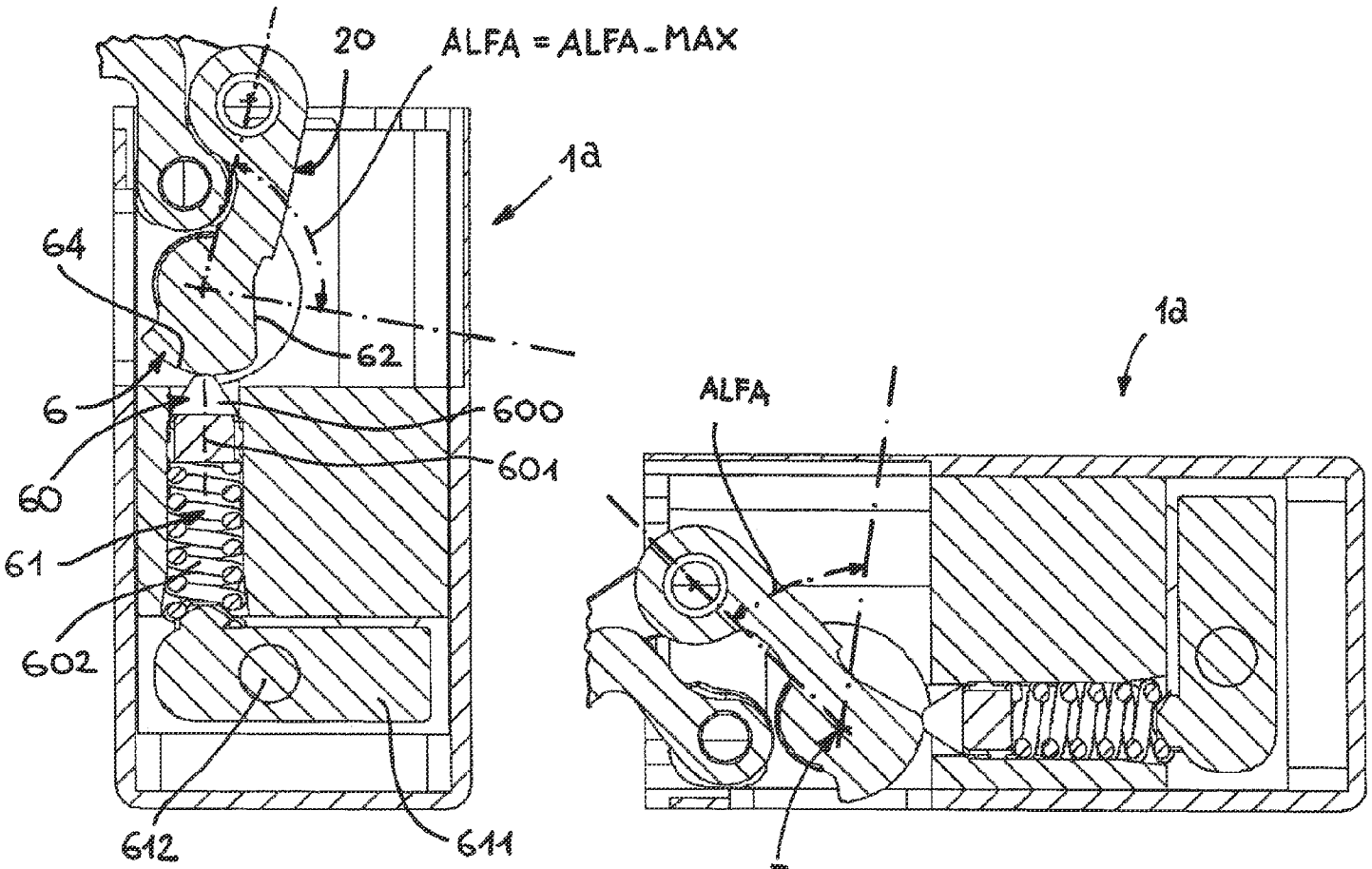
Figure 2A:
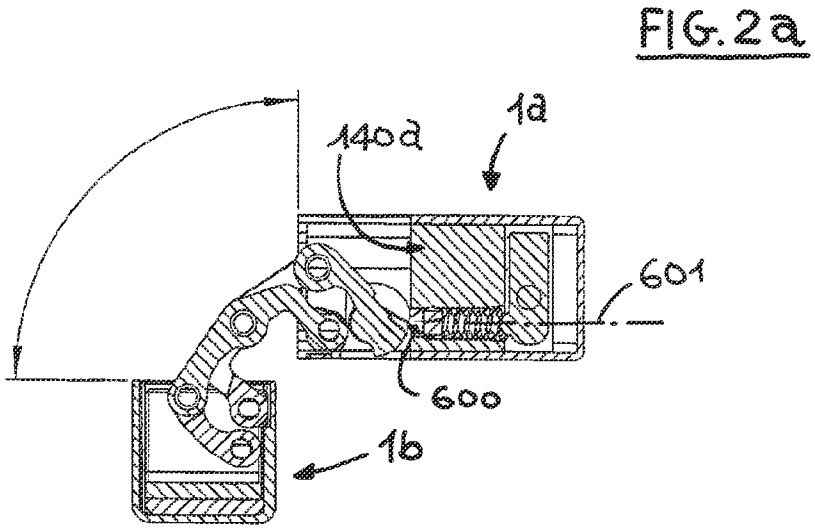
Figure 2B:
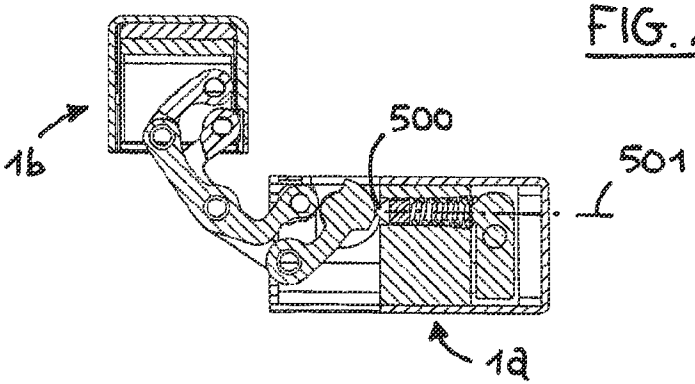
Figure 2:
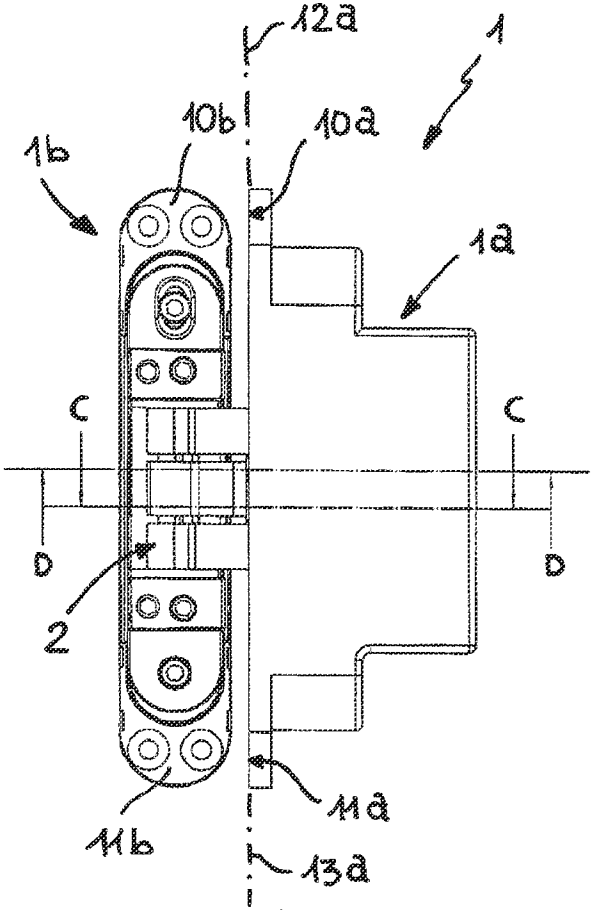
Figure 6A:
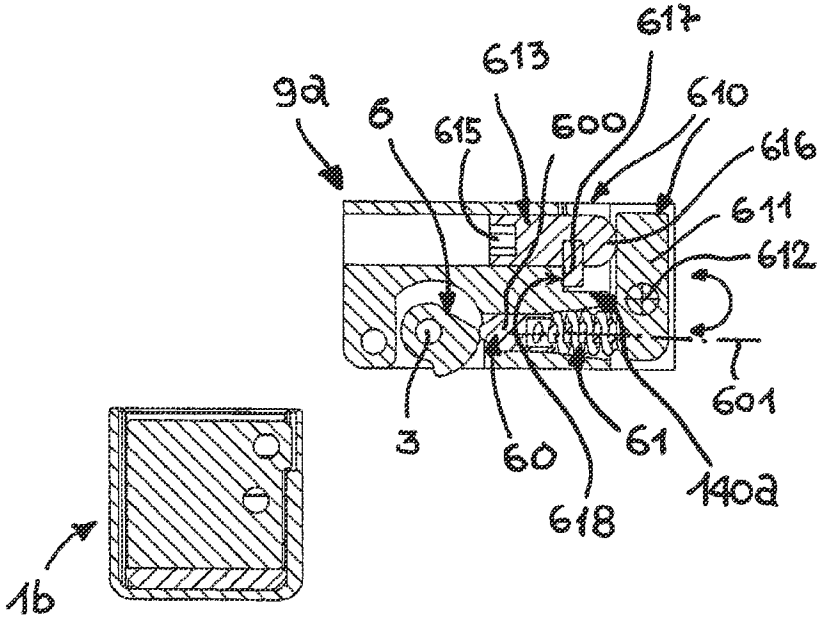
Figure 6:
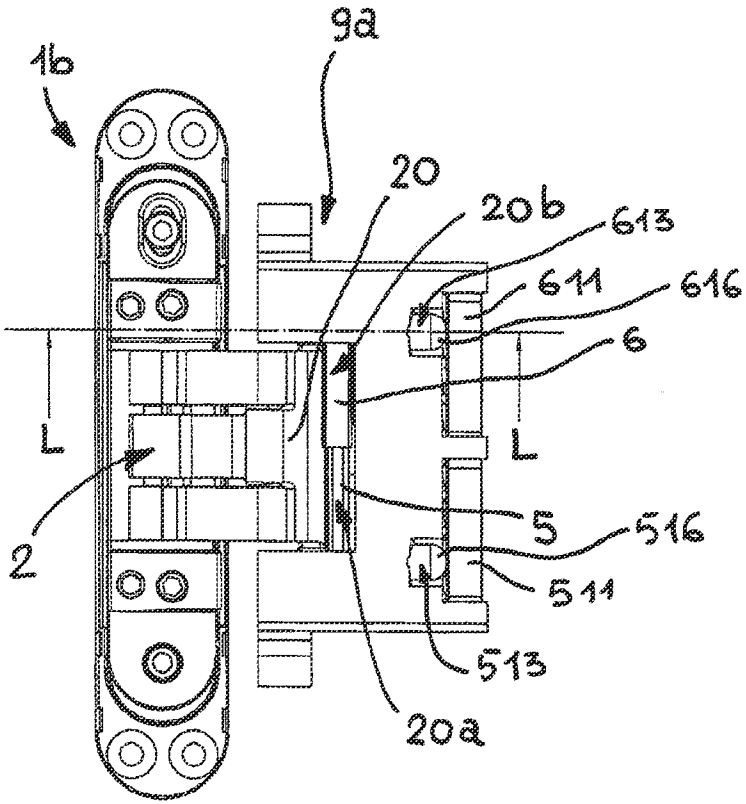

FIG. 6 is a view of the hinge of the invention similar to that of FIG. 2 and where some parts of the fastening member which the closing device is located on are cut away in order to better illustrate others. FIG. 6*a* is a cross section of the hinge through the plane labelled L-L in FIG. 6.

Figure 7A:
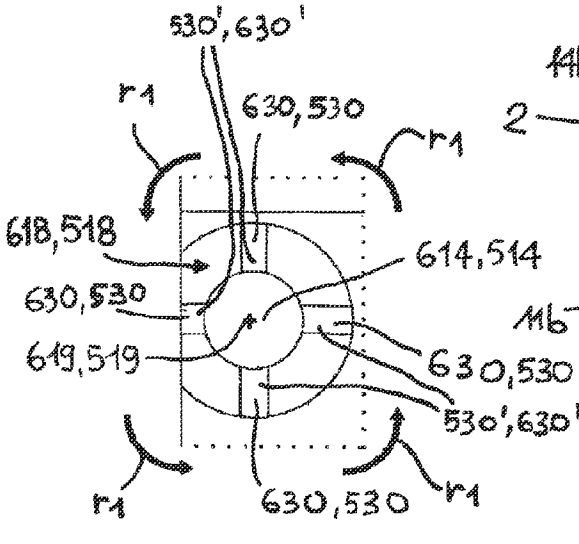
Figure 7:
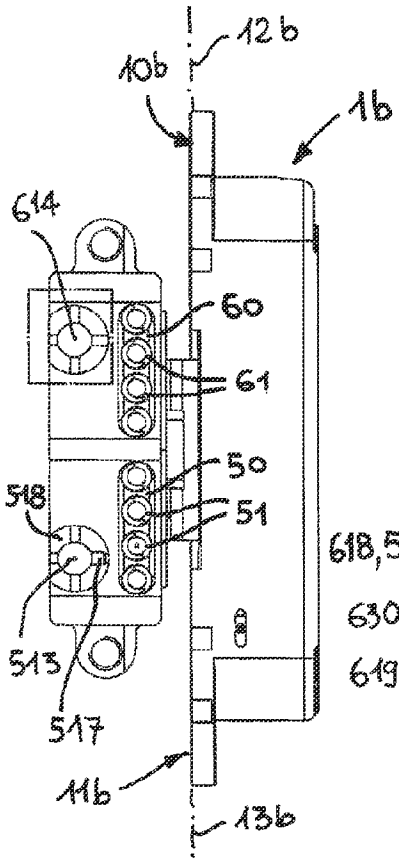

FIG. 7 is a side view of the hinge of FIG. 6, from the right-hand side of FIG. 6, again with some parts cut away in order to better illustrate others. FIG. 7*a* is an enlarged view of the detail shown in the box in FIG. 7.

Figure 8:
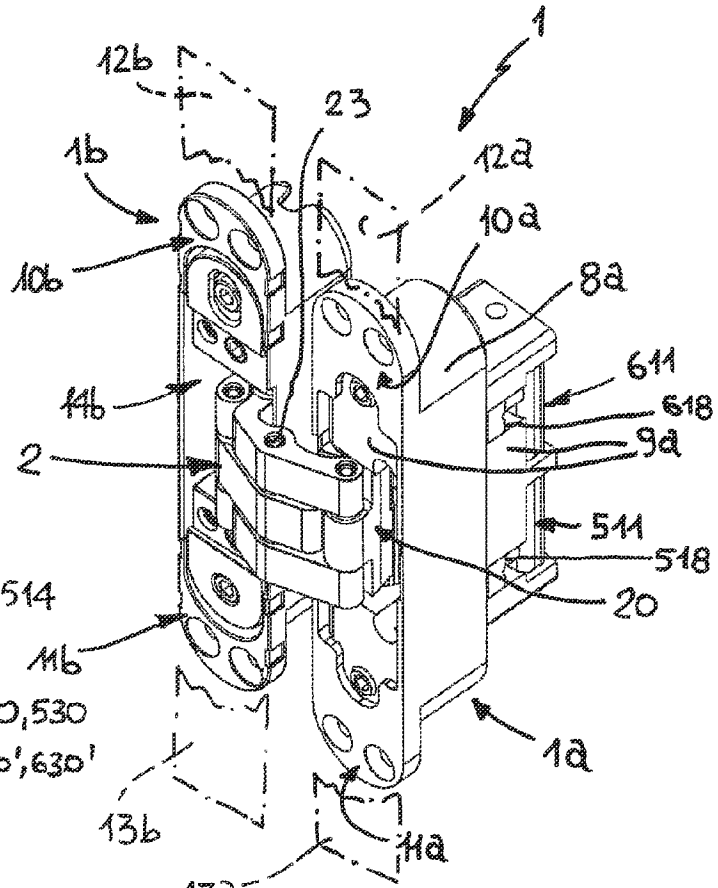

FIG. 8 is a front perspective view of the hinge of the invention, shown in the fully open position.

Figure 9:
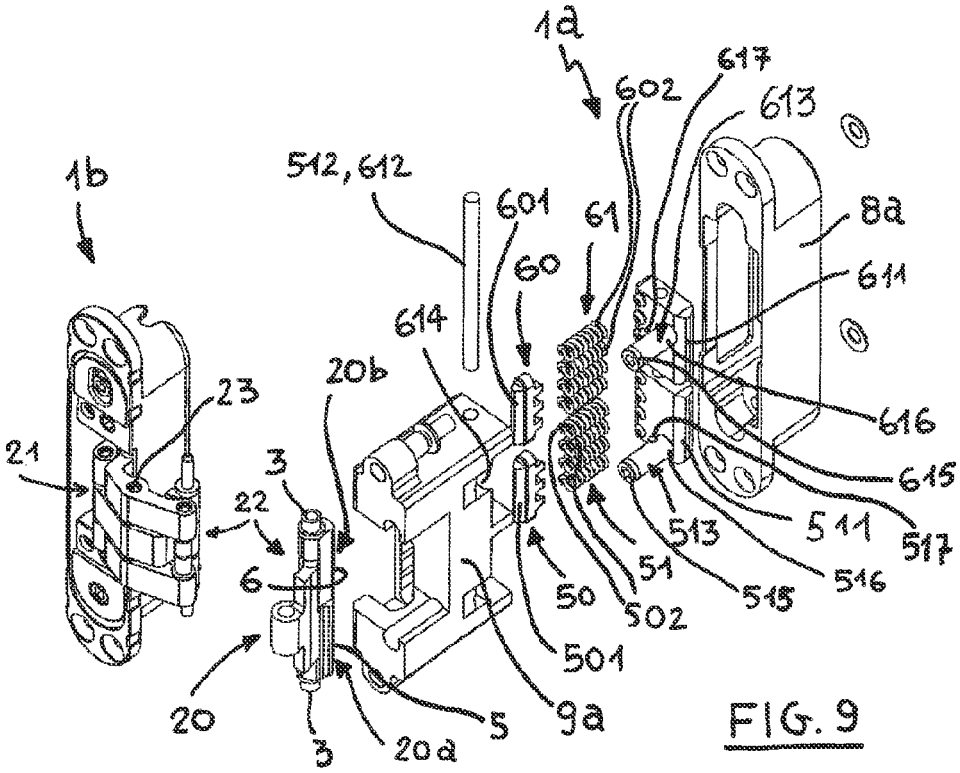
Figure 10:
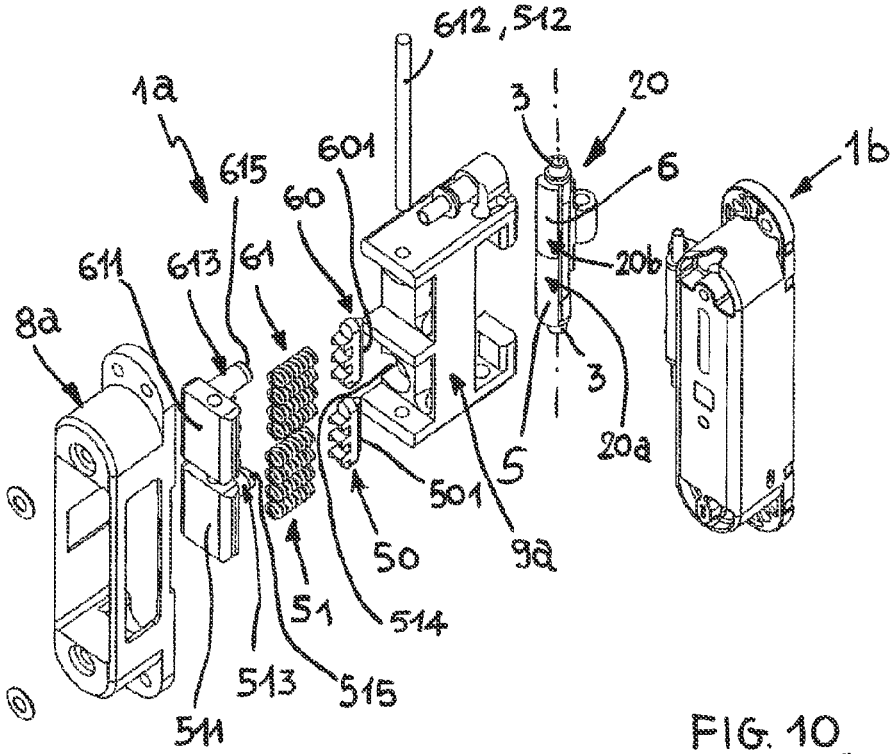
Figure 9A:
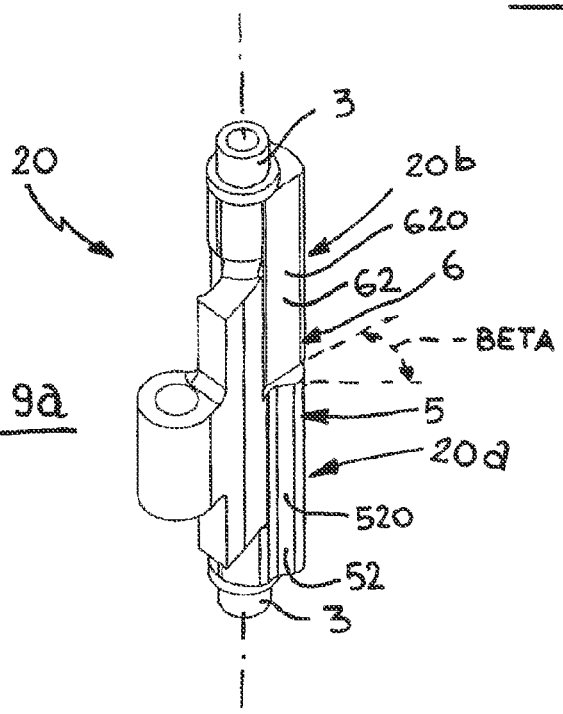

FIGS. 9 and 10 are two perspective views, one from the front and one from the back, of the hinge of the invention, showing an exploded illustration of the fastening member which the closing device is located on. FIG. 9*a* is an enlarged detail from FIG. 9 showing the arm element which the closing device is located on.

Figure 11:
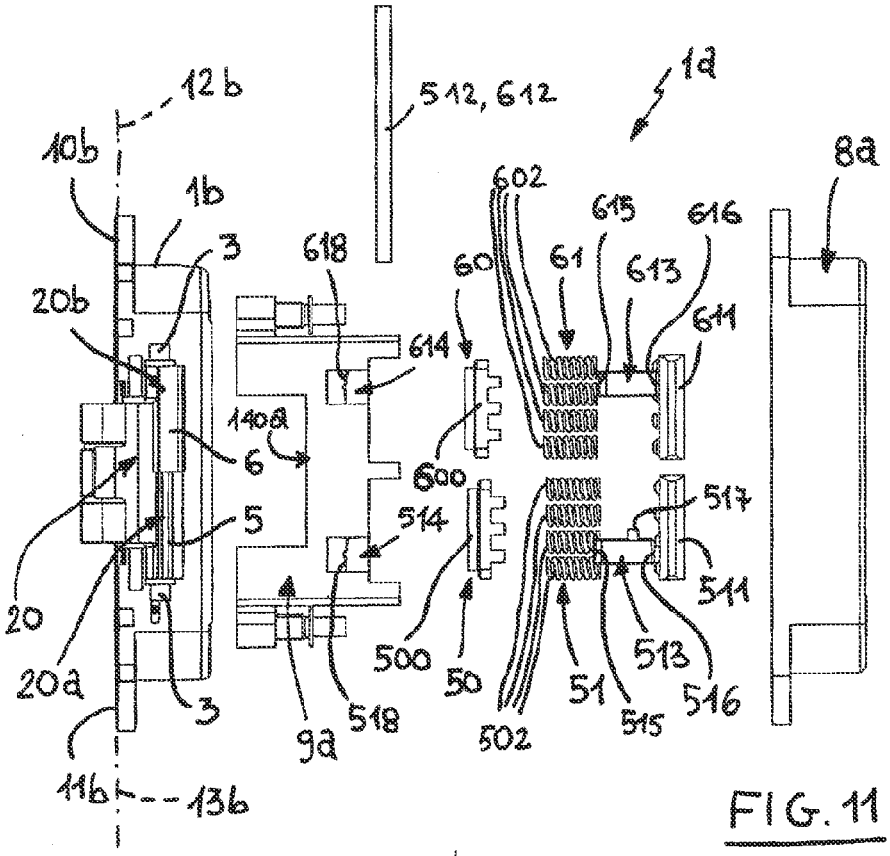

FIG. 11 is a side view of the hinge of the invention in a fully open position, showing an exploded illustration of the fastening member which the closing device is located on.

FIGS. 1*c*, 2*c*, 3*c*, 4*c*, 5*c* are enlarged details from FIGS. 1*b*, 2*b*, 3*b*, 4*b*, 5*b*, respectively.

FIGS. 1*d*, 2*d*, 3*d*, 4*d*, 5*d* are enlarged details from FIGS. 1*a*, 2*a*, 3*a*, 4*a*, 5*a*, respectively.

Figure 12:
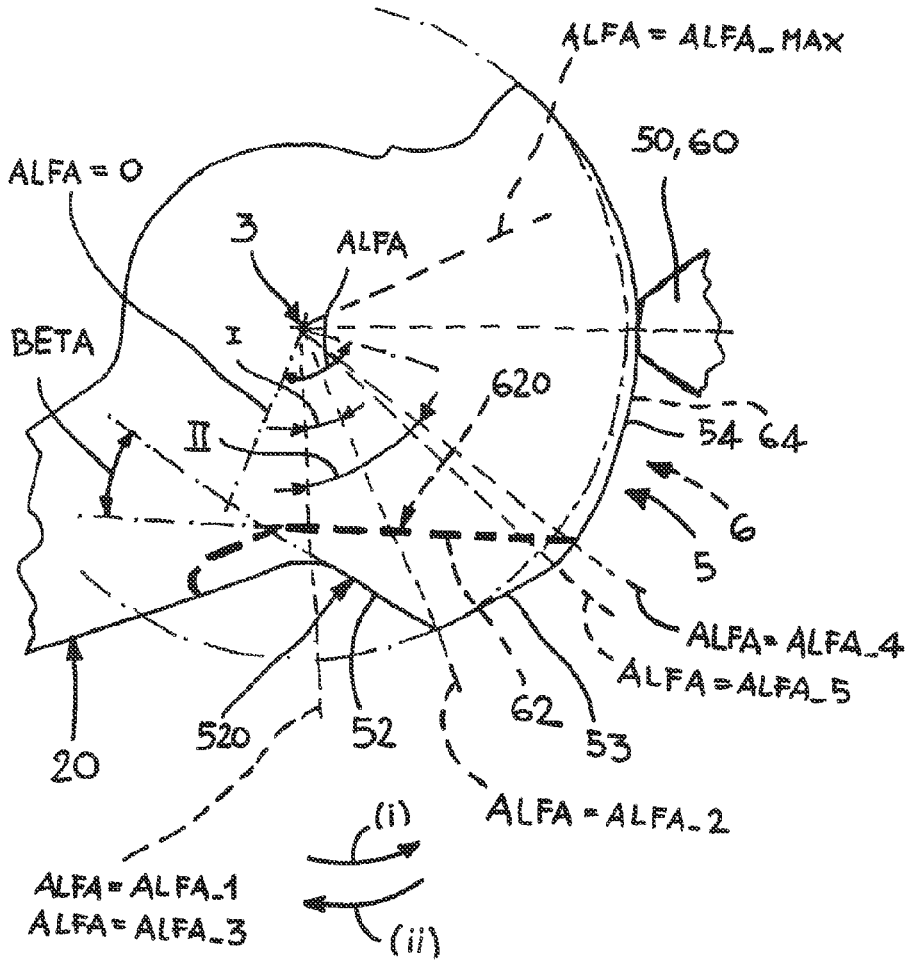

FIG. 12 schematically illustrates, placed over each other, the first and the second earn element of the closing device in the embodiment illustrated also in FIGS. 1 to 11.

Figure 13:
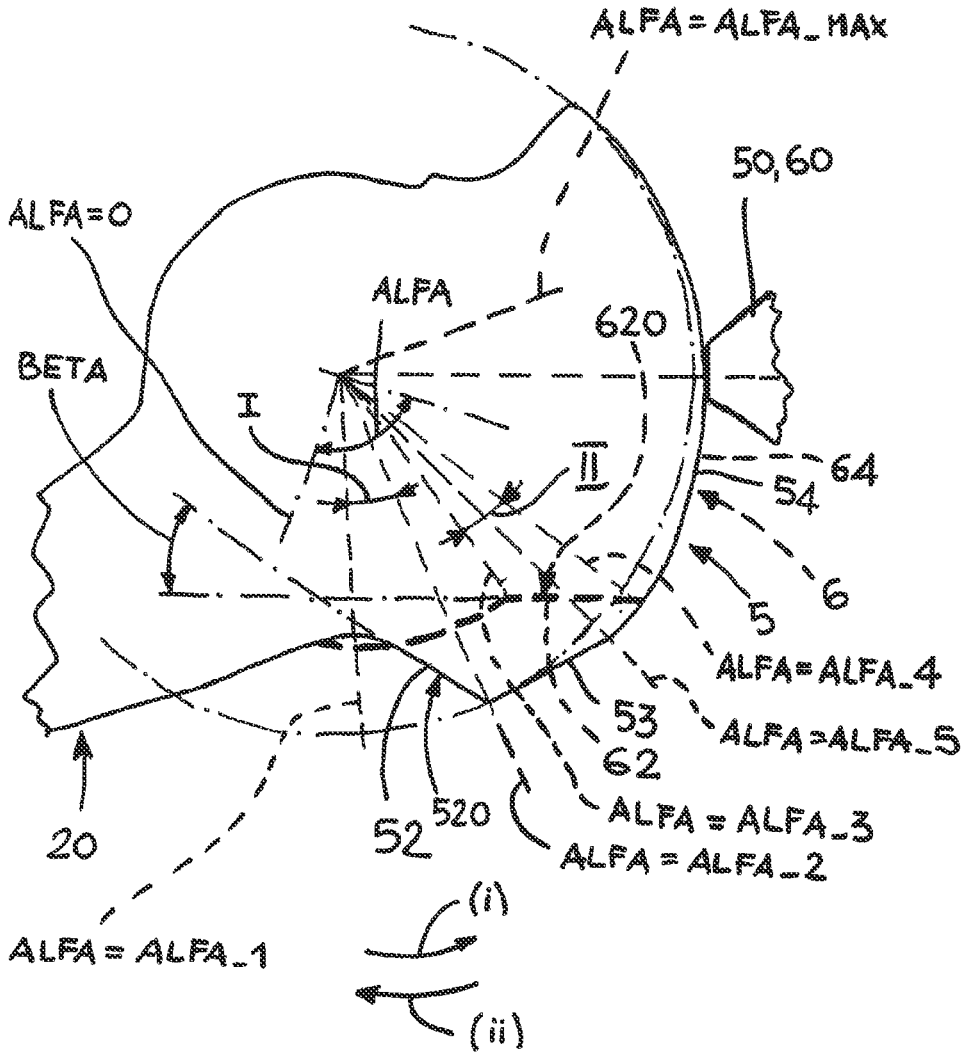

FIG. 13 is a schematic view similar to that of FIG. 12, showing a further embodiment of the cam elements.

Figure 5C:
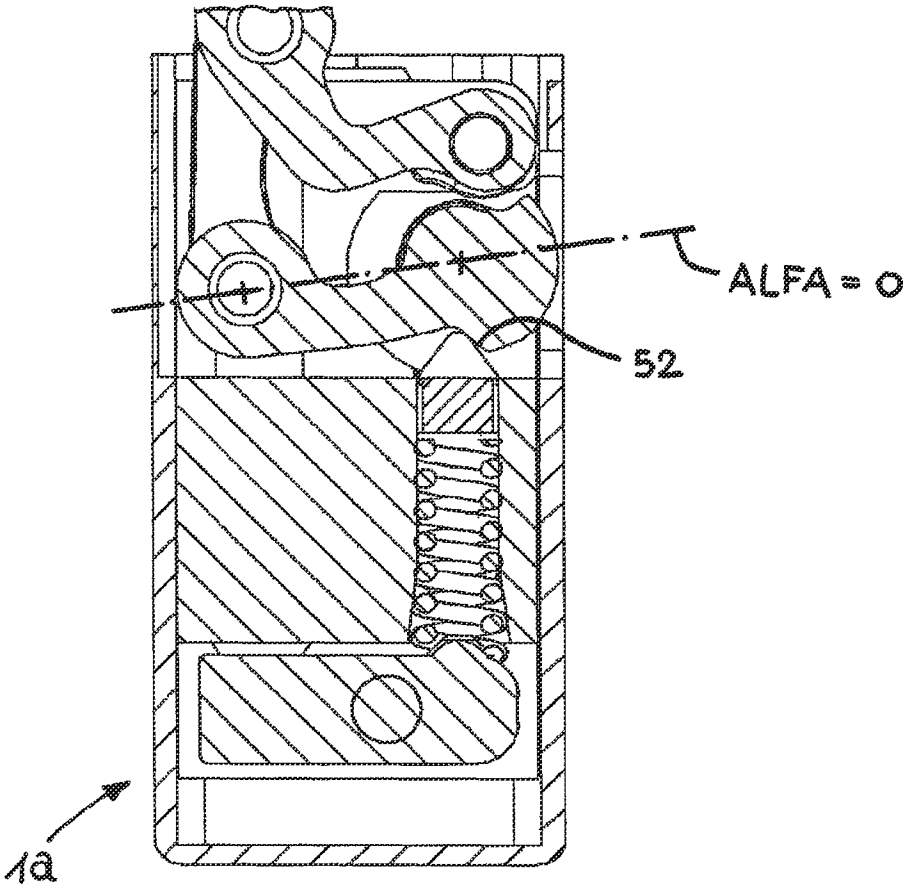
Figure 5D:
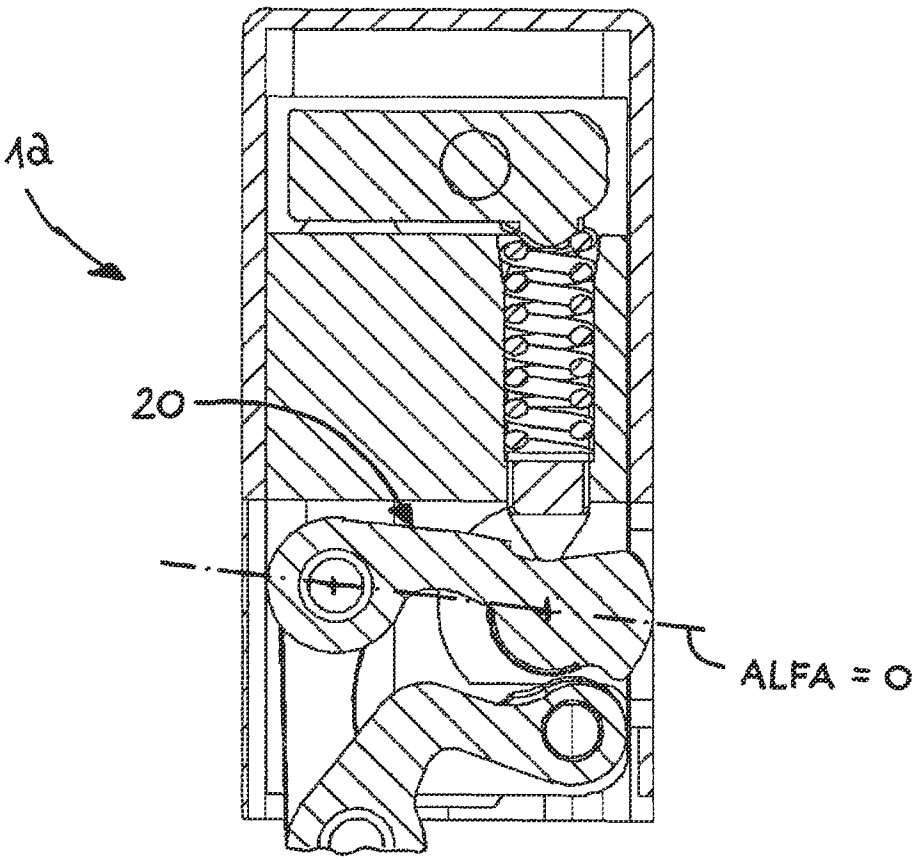
Figure 14B:
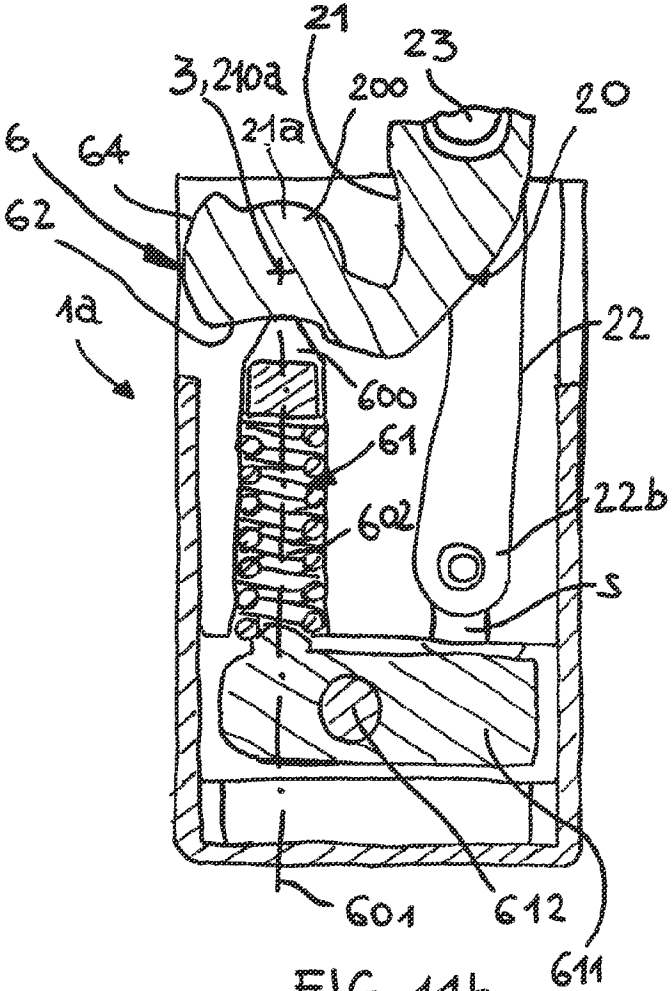
Figure 14A:
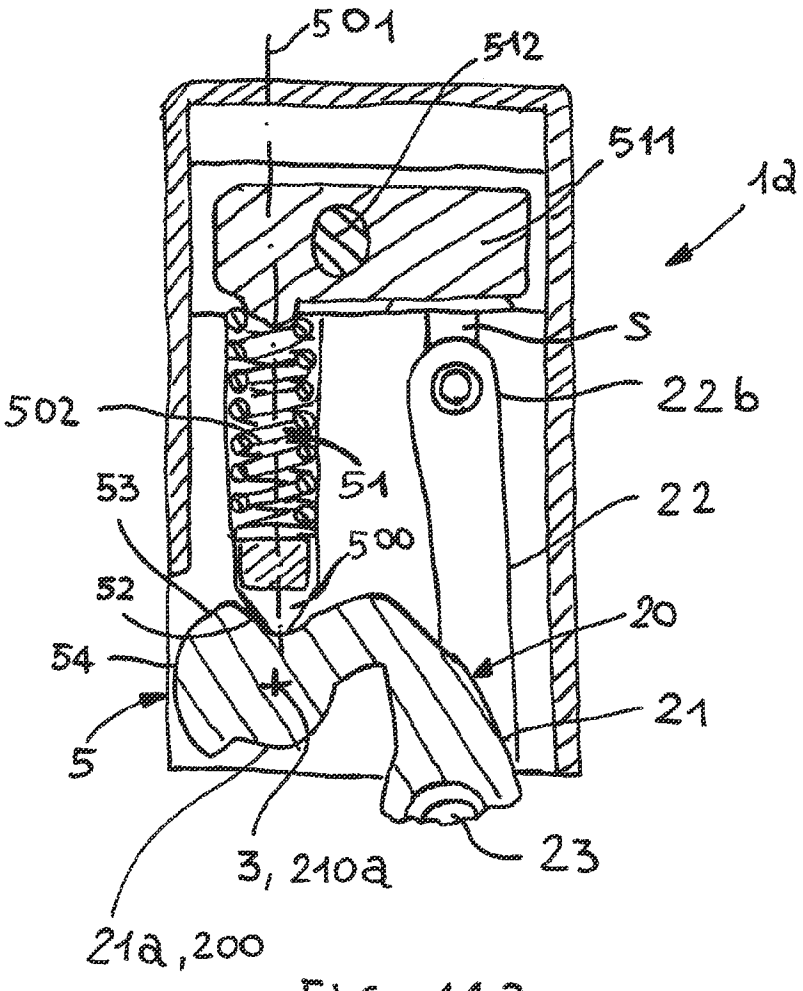

FIGS. 14*a* and 14*b* are cross sections similar to those of FIGS. 5*c* and 5*d*, respectively, illustrating a possible configuration of the closing device of the hinge of the invention in a hinge provided with a 5-point connection device.

With reference to the accompanying drawings, the numeral 1 denotes a fully concealed hinge for doors and/or openable furniture parts according to this invention. The hinge I comprises a first and a second fastening member 1*a*, 1*b*. The first and second fastening members 1*a*, 1*b* are designed to be recessed one in a door or openable furniture part and the other in a respective jamb. The first and second fastening members 1*a*, 1*b* each have at least one respective flat surface portion 10*a*; 11*a*; 10*b*; 11*b* lying in a respective plane 12*a*; 13*a*; 12*b*; 13*b*. The first and the second fastening members 1*a*, 1*b* are connected to each other by a connecting device 2 which allows them to move relative to each other between an open position of the hinge 1, corresponding to the fully open position of the door or openable furniture part (illustrated for example in FIGS. 1, 1*a*, 1*b* and 8), and a closed position of the hinge 1, corresponding to the closed position of the door or openable furniture part (illustrated, for example, in FIGS. 5, 5*a*, 5*b*). The expressions "closed position" and "open position" referred to the hinge are used to indicate the configurations adopted by the hinge when the door or openable furniture part is in the closed and open position, respectively. In the closed position of the hinge 1, the plane 12*a*, 13*a* of the flat surface portion 10*a*, 11*a* of the first fastening member 1*a* faces the plane 12*b*, 13*b* of the flat surface portion 10*b*, 11*b* of the second fastening member 1*b*.

When the hinge 1 is in the closed position, a cavity 14*a* in the first fastening member 1*a* and a cavity 14*b* in the second fastening member 1*b* combine to form a housing for accommodating the connecting device 2.

The flat surface portion 10*a*, 11*a* of the first fastening member 1*a* may be a flat flange portion of the first fastening member 1*a* and used to fasten the first fastening member 1*a* to the door or to the jamb. Similarly, the flat surface portion 10*b*, 11*b* of the second fastening member 1*b* may be a flat flange portion of the second fastening member 1*b* and used to fasten the second fastening member 1*b* to the door or to the jamb. Preferably, both the first fastening member 1*a* and the second 1*b* each comprise a flat surface portion 10*a*, 10*b* and a second flat surface portion 11*a*, 11*b* located on opposite sides of the cavity 14*a*, 14*b*, both being a respective flat flange portion and used to fasten the first fastening member 1*a* and the second 1*b* to the door or to the jamb, respectively. The connecting device 2 comprises an arm element 20 which rotates about a rotation pin 3 of the first fastening member 1*a*. The angle of rotation ALFA of the arm element 20 about the pin 3 adopts a minimum value of zero at the closed position, a maximum value ALFA_MAX which is not zero at the open position and intermediate values between the minimum and the maximum at intermediate positions between the closed and fully open positions. A rotational movement of the arm element 20 corresponds to a respective change of configuration of the connecting device 2. The angle of rotation ALFA of the arm element 20 is shown in FIGS. 1*c*-5*c* and in FIGS. 1*d*-5*d* with reference to the position adopted by the arm element 20 when the hinge 1 is in the closed position corresponding to the value ALFA=0°. The angle of rotation ALFA of the arm element 20 is also shown in FIGS. 12 and 13. The rotation pin 3 is engaged by one end 200 of the arm element 20. The arm element 20 may be part of an articulated arm of the connecting device 2 or it may coincide with the articulated arm of the connecting device 2.

Figure 3:
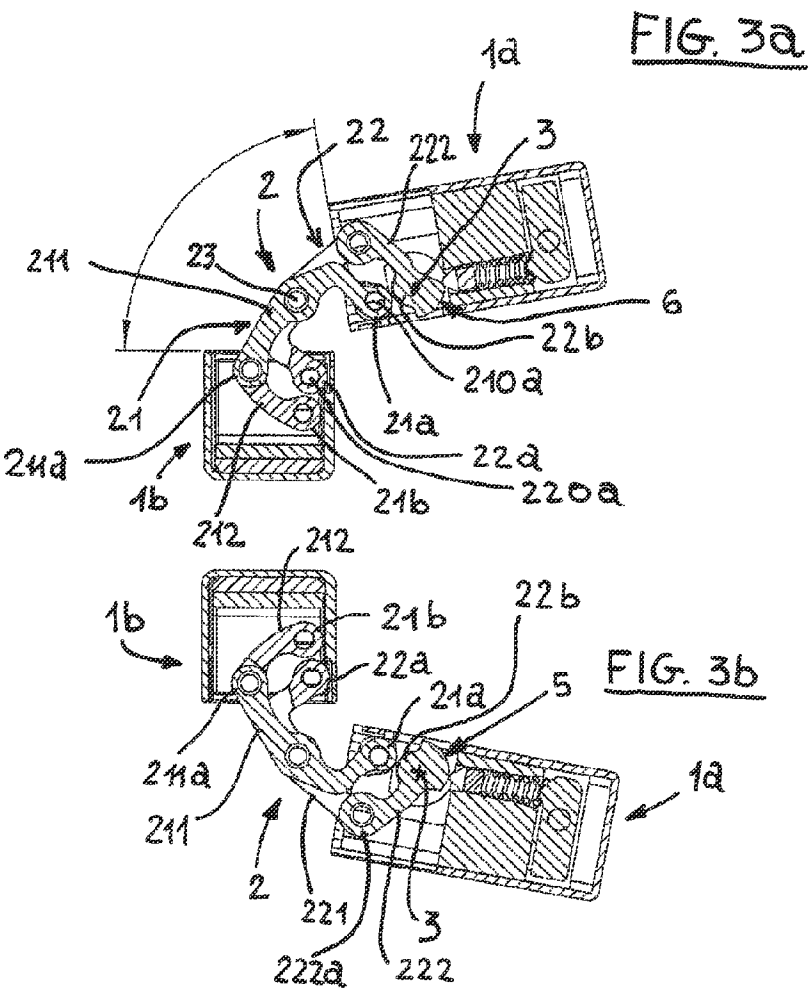
FIG. 3 is a front view of the concealed hinge of the invention in another partly open position, FIGS. 3*a* and 3*b* showing the cross sections of it through the planes labelled, respectively, F-F and E-E in FIG. 3.
Figure 3:
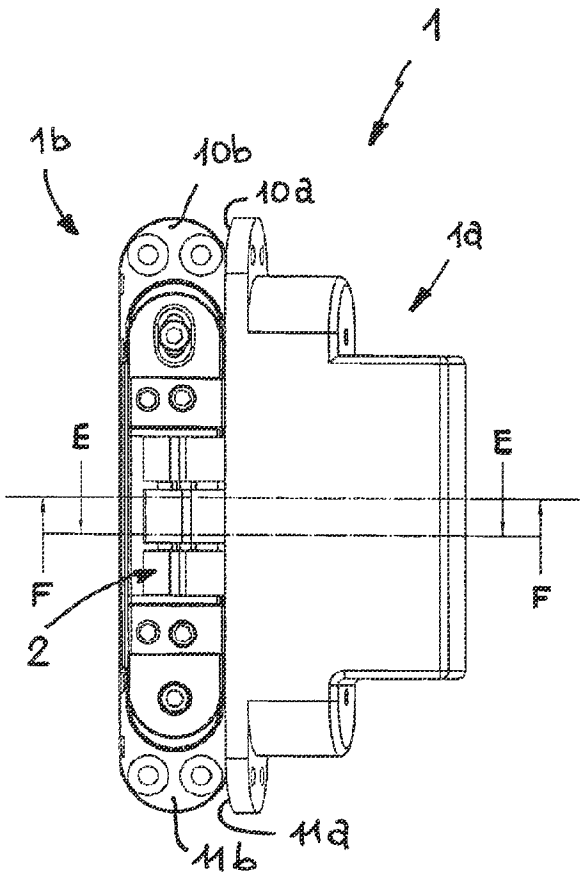
Figure 3C:
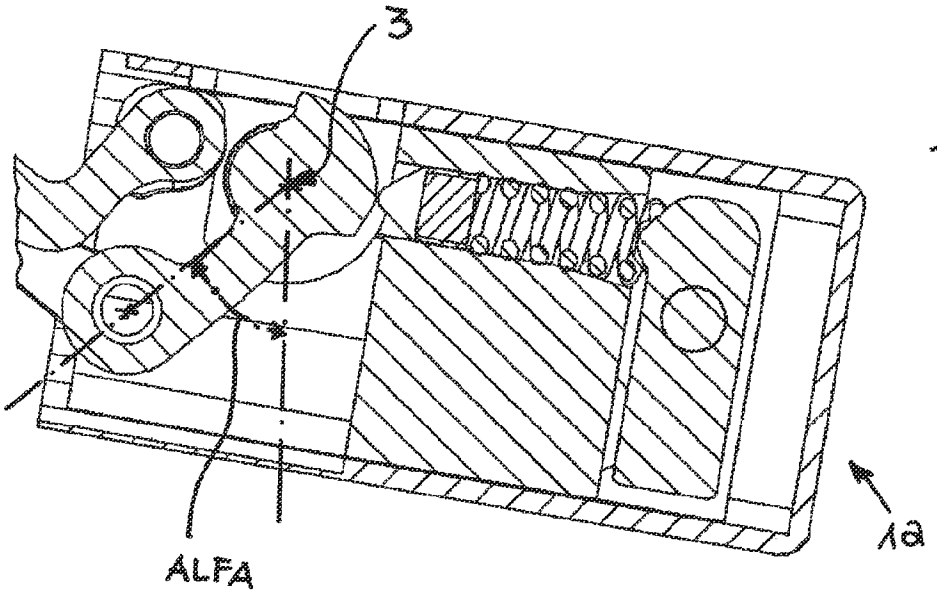
Figure 3D:
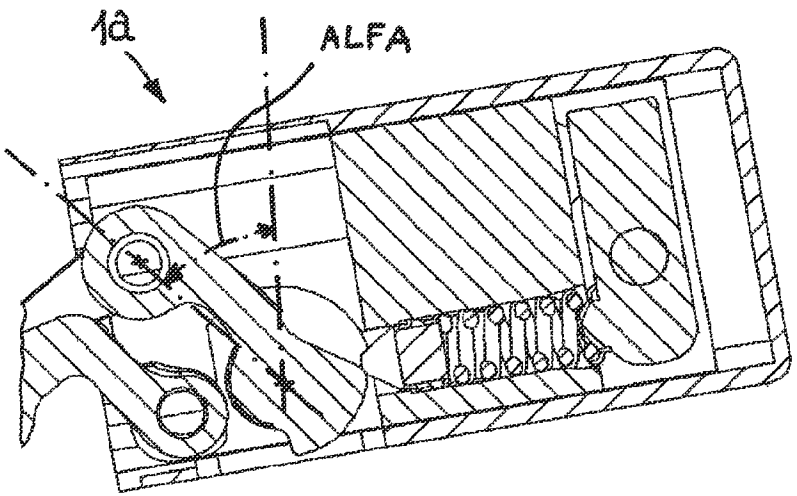

With reference in particular (by way of an example) to FIGS. 3*a* and 3*b*, the connecting device 2 comprises at least a first and a second arm 21, 22 which join the first and second fastening members 1*a*, 1*b* to each other. The first arm 21 has a first end 21*a* which is hinged to the first fastening member 1*a* at a respective hinge pin 210*a* and a second end 21*b* which is operatively engaged on the second fastening member 1*b*. The second arm 22 has a first end 22*a* which is hinged to the second fastening member 1*b* at a respective hinge pin 220*a* and a second end 22*b* which is operatively engaged on the first fastening member 1*a*. The first and second arms 21, 22 are hinged to each other at an intermediate point between their two ends 21*a*, 21*b*; 22*a*, 22*b* at a respective hinge pin 23. Preferably, the hinge pins 210*a*, 220*a*, 23 are parallel to each other. The second end 21*b* of the first arm 21 may be hinged on the second fastening member 1*b* and the second end 22*b* of the second arm 22 may be hinged on the first fastening member 1*a* (this solution being illustrated in FIGS. 1 to 11). In this case, the structure of the arms 21, 22 is preferably the following. The first and second arms 21, 22 are each composed of a first arm portion 211, 212 and a second arm portion 221,222. The first portion 211 of the first arm 21 has a first end which coincides with the first end 21 a of the first arm 21 and a second end 211*b* hinged to a first end of the second portion 212 of the first arm 21. A second end of the second portion 212 of the second arm 21 is hinged on the second fastening member 1*b* and coincides with the second end 21*b* of the first arm 21. The axes of all the hinge pins are preferably parallel to each other. The first portion 221 of the second arm 22 has a first end which coincides with the first end 22*a* of the second arm 22 and a second end hinged to a first end 222*a* of the second portion 222 of the second arm 22. A second end of the second portion 222 of the second arm 22 is hinged on the first fastening member 1*a* and coincides with the second end 22*b* of the second arm 22. The axes of all the hinge pins are preferably parallel to each other. The first portion 211 of the first arm 21 and the first portion 221 of the second arm 22 are hinged to each other at an intermediate point between their ends, and more specifically at the hinge pin 23. In this case, the hinge thus has a "7-point" configuration, with three hinge pins for each arm, plus one pin shared by both arms.

In an embodiment illustrated in FIGS. 14*a* and 14*b* (showing the detail of the significant detail of the first fastening member 1*a* with the hinge 1 in the closed position), the second end 21*b* of the first arm 21 may be engaged in a runner formed on the second fastening member 1*b* and the second end 22*b* of the second arm 22 may be engaged in a runner "s" formed on the first fastening member 1*a*. In this case, if the first and second arms 21, 22 are suitably shaped, the hinge has a "5-point" configuration (two hinge pins 210*a*, 220*a* fixed to the fastening members 1*a*, 1*b*, one movable pin 23 shared by the two arms 21, 22, plus the second ends 21*b* and 22*b* of the two arms 21, 22 which are movable in the sliding guides formed on the two fastening members 1*a* and 1*b*). In this embodiment, the arm element 20 coincides with the first arm 21 and the rotation pin 3 of the arm element 20 coincides with the hinge pin 210*a* (the end 200 of the arm element 20 coinciding with the first end 21*a* of the first arm 21).

Generally speaking, the features of this invention are described hereinafter with reference to a generic connecting device 2 between the first and second fastening members 1*a*, 2*a*. The features of the invention described herein shall, generally speaking and unless otherwise specified, be understood as being independent of the specific structure of the connecting device 2. Generally speaking, where reference is made to the presence of arms 21, 22, the description will always be referring to the presence of two arms. It will, however, be understood that all the considerations herein can be easily and immediately extended to the case where three or more arms are present, unless specific embodiments are expressly mentioned. The hinge I also comprises an automatic closing device 4.

The automatic closing device 4 comprises at least a first cam element 5 and a second cam element 6, formed on a corresponding first portion 20*a* and a second portion 20*b* of the arm element 20, respectively. The first and second portions 20*a* and 20*b* of the arm element 20 each extend around the rotation pin 3 and are located at different positions along the pin 3 itself (FIGS. 9-11, 9*a*). The automatic closing device 4 comprises at least one first tappet 50 which is biased by first elastic means 51. The first elastic means 51 keep the first tappet 50 engaged on the first cam element 5. The automatic closing device comprises at least one second tappet 60 which is biased by second elastic means 61. The second elastic means 61 keep the second tappet 60 engaged on the second cam element 6. The first and second tappets 50, 60 and the respective first and second elastic means 51, 61 are located on the first fastening member 1*a*. The first and second tappets 50, 60 and the respective first and second elastic means 51, 61 are received in the housing formed in combination, when the hinge 1 is in the closed position, by the cavity 14*a* of the first fastening member 1*a* and by the cavity 14*b* of the second fastening member 1*b*.

Below is a description of the structure of the first and second cam elements 5 and 6 with reference to the drawings, in particular FIGS. 12 and 13. FIGS. 12 and 13 show two embodiments of the first and second cam elements 5 and 6, shown superposed over each other. The differences between the first cam element 5 and the second 6 are shown in FIGS. 12 and 13 by the thick dashed lines, which indicate the portions of the second cam element 6 which are not superposed over those of the first cam element 5.

The first cam element 5 comprises a respective active portion 52 with which the first tappet 50 interacts for values of the rotation angle ALFA of the arm element 20 falling within a first angular field "I".

The second cam element 6 comprises a respective active portion 62 with which the second tappet 60 interacts for values of the rotation angle ALFA of the arm element 20 falling within a second angular field "H" which is at least partly not superposed over the first angular field "I".

In the first angular field "I" rotating the arm element 20 in a first rotation direction "i" corresponds to an action of the active portion 52 of the first cam element 5 on the first tappet 50 which progressively loads the first elastic means 51. Rotating the arm element 20 in a second rotation direction "ii", opposite to the first, corresponds to the progressive releasing of the first elastic means 51 and the consequent action of the first tappet 50 on the active portion 52 of the first cam element 5, thereby causing a relative movement of the first and second fastening members 1*a*, 1*b* towards the closed position.

In the second angular field "II" rotating the arm element 20 in the first rotation direction "i" corresponds to an action of the active portion 62 of the second cam element 6 on the second tappet 60 which progressively loads the second elastic means 61. Rotating the arm element 20 in the second rotation direction "ii" corresponds to the progressive releasing of the second elastic means 61 and the consequent action of the second tappet 60 on the active portion 62 of the second cam element 6, thereby c'ausing a relative movement of the first and second fastening members 1*a*, 1*b* towards the closed position.

The first rotation direction "i" of the arm element 20 corresponds to the movement of the hinge from the closed position towards the open position. The second rotation direction "ii" of the arm element 20 corresponds to the movement of the hinge from the open position towards the closed position. Thus, when the user opens the door, the arm element 20 is caused to rotate in the first rotation direction "i" and, consequently, the first elastic means 51 are loaded as the first tappet 50 passes into the first angular field "I" and the second elastic means 61 are loaded as the second tappet 60 passes into the second angular field "II". The fact that the first angular field "I" is at least partial not superposed over the second angular interval "II" means that during the rotation of the arm element 20 in the first rotation direction "i" only the first elastic means 51 or only the second elastic means 61 are loaded for at least one stretch of one of the two angular fields "I", "II". When the user lets go of the door, the tappet 50 being in the first angular field "I" and/or the second tappet 61 being in the second angular field "II" causes the elastic means 51 and the second elastic means 61 to be released in a sequence which is the reverse of the loading sequence, the releasing sequence corresponding to a predetermined kinematic closing scheme of the hinge 1. More specifically, the kinematic closing scheme is determined by: the shape of the active portion 52 of the first cam element 51; the shape of the active portion 62 of the second cam element 6; the position of the first tappet 50 relative to the first cam element 5; the position of the second tappet 60 relative to the second cam element 6; the force of contact between the first tappet 50 and the first cam element 5 due to the position and elasticity properties of the first elastic means 51; the force of contact between the second tappet 60 and the second cam element 6 due to the position and elasticity properties of the second elastic means 61; the size of the first angular field "I" and of the second angular field "II"; the position of the first angular field "I" relative to the second angular field "II"; and the location and size of the zone of non-superposition between the first angular field "I" and the second "II".

The drawings, in particular FIGS. 12 and 13, illustrate the preferred embodiment where, during the rotation of the arm element 20 in the first rotation direction "i", the second elastic means 61 continue to be loaded after the first elastic means 51 have stopped being loaded as the second tappet 60 passes through the portion of the second angular field "II" which is not superposed over the first "I".

The use of at least two cam elements 5, 6 at two different positions along the rotation pin 3 of the arm element and operating on the respective tappets 50, 60 in the respective angular fields "I" and "H" which have at least one portion where they are not superposed over each other, makes it possible to modulate the action of the closing device 4 with extreme versatility, imparting to the door a movement which follows a desired kinematic scheme as a function of the size and extent of superposition of the angular fields "I" and "II". More specifically, even between the open and closed limit positions, it is possible to create angular zones or points whiere the tappets 50, 60 cannot apply any force on the arm element 20 to move the hinge 1 towards the closed position. By also modulating the shape of the cam elements 5, 6 it is also possible to accelerate or slow the movement of the hinge 1 towards the closed position in controlled manner.

Thanks to the special arrangement of the elements of the closing device 4, the hinge 1 is compact and less invasive when it is recessed in the door and/or jamb. As shown in particular in FIGS. 12 and 13, the first angular field "I" is defined by values of the angle of rotation ALFA of the arm element 20 between a first predetermined value ALFA _1 which is greater than or equal to zero, and a second predetermined value $ALFA_{13}$ 2 which is greater than the first value ALFA_1. Rotating the arm element 20 in the first rotation direction "i" increases the rotation angle ALFA in the direction from the first predetermined value ALFA _1 to the second predetermined value ALFA_2. Rotating the arm element 20 in the second rotation dfrection "ii", on the other hand, decreases the rotation angle ALFA in the direction from the second predetermined value ALFA_2 to the first predetermined value ALFA_1. The second angular field "II" is defined by values of the angle of rotation ALFA of the arm element 20 between a third predetermined value ALFA_3 which is greater than or equal to zero, and a fourth predetermined value ALFA_4 which is greater than both the predetermined third value ALFA_3 and the second predetermined value ALFA_2. Advantageously and preferably, the fourth predetermined value ALFA_4 is less than the maximum value ALFA_MAX. Rotating the arm element 20 in the first rotation direction "i" increases the rotation angle ALFA in the direction from the third predetermined value ALFA_3 to the fourth predetermined value ALFA_4. Rotating the arm element 20 in the second rotation direction "ii", on the other hand, decreases the rotation angle ALFA in the direction from the fourth predetermined value ALFA_4 to the third predetermined value ALFA_3.

When, as in FIG. 12, the third predetermined value ALFA_3 of the rotation angle ALFA of the arm element 20 is less than the second predetermined value ALFA_2, the first angular field "I." and the second angular field "II" have a superposition zone which extends from the third predetermined value ALFA_3 to the second predetermined value ALFA_2 (which may coincide with the entire first angular field "I" if the first predetermined value ALFA_1 and the third ALFA_3 coincide or with only an end part of the first angular field "I" in the first rotation direction "i" when the first predetermined value ALFA_1 and the third predetermined value ALFA_3 do not coincide). In this embodiment, which is illustrated in FIGS. 1 to 12, when the hinge passes from the closed position to the open position (that is, when the arm element 20 turns in the first rotation direction "i"), the first and second tappets 50, 60, kept in contact with the respective first and second cam elements 5 and 6, go through the following, in succession:

- first the first angular field "I" (*here the action of the active portion 52 of the first cam element 5 causes the first elastic means 51 to be loaded) and the superposition zone between the first angular field "I" and the second "II" (where the action of the active portion 62 of the second cam element 6 causes a first degree of loading in the second elastic means 61), the superposition zone, as mentioned, possibly coinciding with the entire first angular field "I" if the first predetermined value ALFA_1 and the third predetermined value ALFA_3 of the rotation angle ALFA of the arm element 20 coincide;
- next, the remaining portion of the second angular field "II" (coinciding with at least part of the zone of non-superposition between the two angular fields), where the action of the active portion 62 of the second cam element 6 causes a further degree of loading in the second elastic means 61.

In the embodiment of the invention illustrated in FIG. 13, the first angular field "I" and the second "II" are separate. More specifically, the first angular field "I" and the second "II" are not superposed at all. In this case the third predetermined value ALFA_3 of the rotation angle ALFA of the arm element 20 is greater than or, at most, equal to the second predetermined value ALFA_2. In this case, the first tappet 50 and the second 60 both pass through the second angular field "II" after passing through the first angular field "I". When the third predetermined value ALFA_3 of the rotation angle ALFA of the arm element 20 is strictly greater than the second predetermined value ALFA_2, the first and second cam elements 5, 6 can be shaped in the angular interval between ALFA=ALFA_2 and .ALFA. =ALFA _3 in such away that their effect on the tappets 50, 60 (and on the respective elastic means 51, 61) is substantially neutral (for example by giving the surface of the cam elements 5, 6 in that angular interval the shape of cylindrical portions whose axis lies on the rotation pin 3 and on which the loading level of the respective elastic means 51, 61 remains unchanged if the distance between the tappets 50, 60 and the rotation pin 3 does not change). It is thus possible to define an intermediate zone between the two angular fields "I" and "II" where the hinge can remain in a partly open position even if the user is not holding it. More specifically, since the elastic force in that intermediate zone is balanced, neither the first elastic means 51 nor the second elastic means 61 can apply on the respective cam elements 5, 6 any action that might, if the user lets go of the door, move the hinge 1 towards the closed position by rotating the arm element 20 in the second rotation direction "ii". Moreover, in the embodiment illustrated in FIG. 13, the effect of the surface of the second cam element 6 on the second tappet 60 and on the respective second elastic means 61 may be neutralized in the first angular field "I" by giving the surface portion in the first angular field "I" the shape of a cylindrical element whose axis ties on the rotation pin 3. If the distance of the second tappet from the rotation pin 3 remains unchanged, the state of tension of the second elastic means 61 remains unchanged. Since the elastic force in that angular field is balanced, the second elastic means 61 cannot apply any action that might cause the arm element 20 to rotate in the second rotation direction "ii".

Preferably, the first angular field "I" corresponds to an angle of opening the hinge 1 from a closed position (corresponding to an angle of 0°, FIGS. 5*a*, 5*b*) to a partly open position corresponding to a door opening angle of approximately 30° (FIGS. 4*a*, 4*b*). Preferably, the second angular field "I" corresponds to an angle of opening the hinge 1 from a partly open position (corresponding to a door opening angle of approximately 30° (FIGS. 4*a*, 4*b*) to a partly open position corresponding to a door opening angle of approximately 90° (FIGS. 2*a*, 2*b*). If, as in FIG. 12, the first and second angular fields "I", "II" are partly superposed, it is possible, by suitably choosing the rigidity and properties of the first and second elastic means 51, 61, and their degree oftensioning at start (that is, with reference to the first rotation direction "i", the degree of tensioning corresponding to it when the first and second tappets 50,60 are at the position corresponding to the first predetermined value ALFA_1 of the rotation angle of the angle ALFA of the arm element 20), to make the loading level reached by the second elastic means 61 tow or negligible compared to that reached at the same time by the first elastic means 51 on the first angular field "I" in the superposition zone between the two angular fields "I" and "II" when the arm element 20 turns in the first rotation direction "i". The mechanical effect thus obtained is thus similar to that which might be Obtained if the first and second angular fields "I" and "II" were separate from each other.

As stated above, advantageously and preferably, the fourth predetermined value ALFA_4 of the rotation angle ALFA of the arm element 20 is less than the maximum value ALFA_MAX. That makes it possible to create a condition where both the first and the second elastic means 51, 61 are substantially neutral. More specifically, in the angular field between the fourth predetermined value ALFA_4 of the rotation angle ALFA of the arm element 20 and the maximum value ALFA_MAX it is possible to give the surface of the first and second cam elements 5, 6 the shape of cylindrical surface sections whose axis lies on the rotation pin 3, creating a state of substantial stability in the tension of the first and second elastic means 51, 61 and a balance in their elastic forces.

With reference again to FIGS. 12 and 13 in particular, the first cam element 5 and the second 6 each comprise a respective end portion 54, 64, with which the first tappet 50 and the second 60 come respectively into contact for values of the angle of rotation ALFA of the arm element 20 between the fourth predetermined value ALFA_4 and the maximum value ALFA_MAX. As mentioned above, the terminal portions 54, 64 may be made in such away that the action on them of the tappets 50, 60 and of the respective elastic means 51, 61 is balanced and the closing device 4 thus neutralized. Advantageously, in the embodiment illustrated in FIGS. 12 and 13, during interaction between tappet and cam element, the first elastic means 51 and the second 61 keep their loading level constant or decrease it on the end portion 54 of the first cam element 5 and on the second end portion 64 of the second cam element 6, respectively, when the arm element 20 is rotated in the first rotation direction. This feature tends to make the fully open position of the hinge 1 stable. For this purpose, it is sufficient for an effect, even an extremely limited one, of releasing the first and second elastic means 51, 61 to occur on the end portion 54 of the first cam element 5 and on the second end portion 64 of the second cam element 6, respectively, by rotating the arm element 20 in the first rotation direction "i". In FIGS. 12 and 13, the profile of the end portion 54, 64 of each cam element 5, 6 is compared purely by way of an example with a circular profile shown by the dot-dashed line.

Conveniently, the first cam element 5 comprises a first auxiliary portion 53 which follows the active portion 52 in the first rotation direction "i" and with which the first tappet 50 comes into contact for values of the rotation angle ALFA between the second predetermined value ALFA_2 and a fifth predetermined value ALFA_5 less than or, at most equal to, the fourth predetermined value ALFA_4. The auxiliary portion 53 of the first cam element 5 covers, on the first cam element 5, the angular distance which separates, along the first rotation direction "i", the end of the first angular field "I" from the end of the second angular field "II". During interaction between the auxiliary portion 53 and the first tappet 50, during rotation of the arm element 20 in the first rotation direction "i", the increase in the loading applied by the first elastic means 51 per rotation angle unit is zero or a value smaller than that which occurs on the active portion 52. The value of the further overall loading applied by the first elastic means 51 on the first auxiliary portion 53 depends on the size of the angular interval between the second predetermined value ALFA_2 of the rotation angle ALFA of the arm element 20 and the fifth predetermined value ALFA_5. More specifically, the value of this further loading applied by the first elastic means 51 is equal to the integral of the increase in the loading applied by the first elastic means 51 per rotation angle unit in the angular interval between the second predetermined value ALFA_2 of the rotation angle ALFA of the arm element 20 and the fifth predetermined value ALFA_5. Conveniently, the value of this further loading applied by the first elastic means 51 is less than the level of loading applied on the active portion 52 of the first cam element 5. Preferably, the value of this further loading applied by the first elastic means 51 is zero or negligible compared to the level of loading applied on the active portion 52 of the first cam element 5. More specifically, the conditions created on the first auxiliary portion 53 are such that the action of the first tappet 50 and of the respective first elastic means 51 on the kinematics of the connecting device 2 and of the hinge 1 is substantially neutral. That way, in the angular field covered by the first auxiliary portion 53, the closing movement is slowed or stopped or a zone is cretated where the door or openable furniture part can remain stationary or substantially free unless it is moved by the user. The first auxiliary portion 53 of the cam element 5 connects the active portion 52 with the end portion 54 of the first cam element 5. The first auxiliary portion 53 may be made in the form of a flat surface element.

Preferably, the active portion 52 of the first cam element 5 and the active portion 62 of the second cam element 6 are each defined by a respective flat surface 520, 620 parallel to the axis of rotation which is defined by the rotation pin 3 of the arm element 20 and which does not contain that axis. The flat surfaces 520, 620, defining the active portion 52 of the first cam element 5 and the active portion 62 of the second cam element 6, respectively, are inclined to each other at a predetermined angle BETA which is not zero and is less than a right angle (FIGS. 9*a*, 12, 13).

Advantageously, the plane in which the flat surface 520 of the active portion 52 of the first cam element 5 lies is obtained from. the plane in which the flat surface 620 of the active portion 62 of the second cam element 6 lies by rotating the latter about the axis of the rotation pin 3 of the arm element 20 in the second rotation direction "ii" through an angle equal in value to the difference between the fourth predetermined value ALFA_4 and the second predetermined value ALFA_2 of the rotation angle ALFA of the arm element 20. The active portion 52 of the first cam element 5 and the active portion 62 of the second cam element 6 are thus rotated relative to each other about the axis of the rotation pin 3 by an angle equal to the difference between the fourth predetermined value ALFA_4 and the second predetermined value ALFA_2 of the rotation angle ALFA of the arm element 20.

The first and second tappets 50, 60 each comprise at least one respective pusher 500, 600 movable along an axis 501, 601 which, when the tappet 50, 60 the pusher 500, 600 belongs to is in contact with the respective active portion 52, 62, is transversal to the plane of the respective flat surface 520, 620. The pusher 500, 600 is opposed, in a direction away from the axis of the rotation pin 3, by at least one respective helical spring 502, 602.

Advantageously, the axis 501 along which the pusher 500 of the first tappet 50 moves and parallel to which the helical spring 502 operates is parallel to the axis 601 along which the pusher 600 of the second tappet 60 moves and parallel to which the helical spring 602 operates. Conveniently, the plane defined by the axis 501 along which the pusher 500 of the first tappet 50 moves and by the axis 601 along which the pusher 600 of the second tappet 60 moves contains the axis of the rotation pin 3 of the arm element 20. The pusher 500 of the first tappet 50 is advantageously opposed, in a direction away from the axis of the rotation pin 3, by a plurality of helical springs 502. The helical springs 502 are preferably all parallel to each other. The pusher 600 of the second tappet 60 is advantageously opposed, in a direction away from the axis of the rotation pin 3, by a plurality of helical springs 602. The helical springs 602 are preferably all parallel to each other.

Generally speaking, in any embodiment of the invention, it is possible to predetermine the degree of tensioning of the first and second elastic means 51, 61 at start (that is, with reference to the first rotation direction "i", the degree of tensioning corresponding to it when the first and second tappets 50, 60 are at the position corresponding to the first predetermined value ALF A_1 of the rotation angle of the angle ALF A of the ami element 20) once for all by selecting the rigidity of the selfsame elastic means 51, 61 and/or by defining the fixed geometric constraints in the hinge 1.

Preferably, the hinge 1 of the invention contemplates the possibility of adjusting the state of preloading of the first and second elastic means 51, 61 through the agency of respective preloading means which can be activated by the user. More specifically, the hinge 1 comprises a first preloading device 510 acting on the first elastic means 51 and ble to be set by the user at a predetermined value of minimum contact force between the first tappet 50 and the active portion 52 of the first cam element 50 selectable from a plurality of predetermined minimum values. The plurality of predetermined minimum values may consist of a discrete set of values. The plurality of predetermined minimum values may consist of a continuous interval of values between a lower limit and an upper limit. The hinge 1 also comprises a second preloading device 610 acting on the second elastic means 61 and able to be set by the user at a predetermined value of minimum contact force between the second tappet 60 and the active portion 62 of the second cam element 60 selectable from a plurality of predetermined minimum values. The plurality of predetermined minimum values may consist of a discrete set of values. The plurality of predetermined minimum values may consist of a continuous interval of values between a lower limit and an upper limit.

Advantageously, the second preloading device 610 can be set by the user independently of the first preloading device 510. It is thus possible to adjust the state of tensioning of the first elastic means 51 at start independently of that of the second elastic means 61.

The first preloading device 510 and the second 610 each comprise a respective rocker 511, 611 and a respective selector 513, 613 operating on the rocker 511, 611. Each rocker 511, 611 is pivoted about a respective axis 512, 612. On one side of its axis 512, 612, each rocker 511, 611 is in contact with the respective elastic means 51,61; on the opposite side of its axis 512; 612, each rocker is in contact with the respective selector 513, 613. More specifically, the axis 512, 612 of each rocker 511, 611 is parallel to the axis of the rotation pin 3 of the arm element 20. Further, on one side of its axis 512, 612, each rocker 511, 611 is in contact with the helical spring 502, 602 for with the plurality of parallel helical springs 502, 602) of the respective elastic means 51, 61; on the opposite side of its axis 512, 612, each rocker 511, 611 is in contact with the respective selector 513, 613.

Advantageously, the axis 512 of the rocker 511 of the first preloading device 510 coincides with, the axis 612 of the rocker 611 of the second preloading device 610. The rocker 511 of the first preloading device 510 and the rocker 611 of the second preloading device 610 are pivoted about the same axis and are, preferably, located one after the other along the common pivot axis 512, 612.

The first tappet 50 (more specifically, the pusher 500) and the first elastic means 51 (more specifically, the respective helical spring 502 or the respective parallel helical springs 502) are fitted between the first cam element 5 (and/or the end 200 of the arm element 20) and the rocker 511 of the first preloading device 510. The second tappet 60 (more specifically, the pusher 600) and the second elastic means 61 (more specifically, the respective helical spring 602 or the respective parallel helical springs 602) are fitted between the second cam element 6 (and/or the end 200 of the arm element 20) and the rocker 611 of the second preloading device 610.

The selector 513 of the first preloading device 510 and the selector 613 of the second preloading device 610 are each accessible to the user at least when the hinge 1 is in the open position. Each selector 513, 613 selects an angle of rotation of the respective rocker 511, 611 either in the direction in which the respective tappet 50, 60 moves in order to push the respective cam element 5, 6, compressing the first elastic means 51 or the second elastic means 61 (more specifically, the helical spring 502, 602 or the helical springs 502, 602), or in the opposite direction to obtain the opposite effect.

The selector 513 of the first preloading device 510 is located alongside the first tappet 50. More specifically, the selector 513 of the first preloading device 5110 is alongside the pusher 500 and the respective helical spring 502 (or the respective helical springs 502), in particular with one axis of it parallel to the axis 501 along which the pusher 500 is movable. That axis is perpendicular to the axis 512 about which the rocker 511 of the first preloading device 510 is pivoted. The selector 613 of the second preloading device 610 is located alongside the second tappet 60. More specifically, the selector 613 of the second preloading device 610 is alongside the pusher 600 and the respective helical spring 602 (or the respective helical springs 602), in particular with one axis of it parallel to the axis 601 along which the pusher 600 is movable. That axis is perpendicular to the axis 612 about which the rocker 611 of the second preloading device 610 is pivoted.

Each selector 513, 613 may be in the form of an adjustment screw engaged in a threaded hole in the first fastening member la. One end of the adjustment screw can be accessed by the user with a tool from inside the cavity 14*a* of the first fastening member when the hinge 1 is in the open position. The other end of the adjustment screw, opposite the first end, is in contact with the respective rocker 511, 611 on the side of the latter opposite the tappet 50, 60 with respect to the pivot axis 512, 612 of the selfsame rocker 511, 611.

Each selector 513, 613 is preferably in the form of an element which rotates in a respective hole 514, 614 made in the first fastening member 1*a*. On one side of the hole 514, 614, the selector 514, 614 has a first end 515, 615 which can be accessed by the user from the cavity 14*a* of the first fastening member 1*a* when the hinge is in the open position. A tool may be inserted into that end 515, 615 in order to turn the selector 513, 613 about an axis of it coinciding with the axis of the hole 514, 614. On the opposite side of the hole 514, 614, the selector has a second end 516, 616 which is in contact with the respective rocker 511, 611. Each selector 513, 613 also comprises a transversal protuberance 517, 617 designed to abut against an edge wall 518, 618 of the side of the hole 514, 614 directed towards the respective rocker 511, 611. The abutting contact between the transversal protuberance 517, 617 and the edge wall 518, 618 is guaranteed by the pushing action applied by the rocker 511, 611 on the second end 516, 616 of the selector 513, 613 by effect of the elastic means 51, 61 (more specifically, of the helical springs, 502, 602). Moving ideally on the edge wall 518, 618 along a path extending around a longitudinal axis 519, 619 of the hole 514, 614 in a first rotation direction "r1." (FIG. 7*a*), zones 530, 630 of the edge wall 518, 618 are encountered at progressively decreasing distances from the side of the hole 514, 614 directed towards the cavity 14*a* of the first fastening member 1*a*. These zones 530, 630 may be made by giving the edge wall 518, 618 a shape which is helical about the longitudinal axis 519, 619 of the hole 514, 614. In a preferred embodiment, the edge wall 518, 618 is flat as a whole and the zones 530, 630 are in the form of grooves 530', 630' which are radial to the longitudinal axis of the hole 514, 614, the radial grooves 530', 630' having progressively decreasing depth as one moves around the longitudinal axis 519, 619 in a third rotation direction "r1". The transversal protuberance 517, 617 may be received at least partly in each of the radial grooves 530', 630'. There may be a plurality of these radial grooves 530', 630'. In the embodiment illustrated in the drawings, the edge wall 518, 618 has four radial grooves 530', 630' arranged along the diagonals of an ideal square centred on the longitudinal axis 519, 619 of the hole 514, 614.

Acting on the first end 515, 615 of the selector 513, 613 (for example with a tool) and making the selector 513, 613 rotate about its axis in the hole 514, 614 in the third rotation direction "r1" causes the transversal protuberance 517, 617 to slide on the edge wall 518, 618 and to progressively pass over different zones 530, 630 at progressively increasing distances from the side of the hole 514, 614 which is directed towards the cavity 14*a* of the first fastening member 1*a*. This causes also the second end 516, 616 of the selector 513, 613 to move away from the side of the hole 514, 614 which is directed towards the cavity 14*a* of the first fastening member 1*a*, thereby pushing the rocker 511, 611 so it compresses the elastic means 51, 61 (more specifically, the helical springs 502, 602). In the preferred embodiment illustrated in the drawings, each time the transversal protuberance 517, 617 encounters a radial groove 530', 630, it snaps into it by effect of the reaction of the elastic means 51, 61, thus stabilizing the corresponding preload selection. Rotating the selector 513, 613 in the third rotation direction "r1" causes an increase in the compression level of the elastic means 51, 61 (more specifically, of the helical springs 502, 602) and hence, an increase in the preload level. Rotating the selector 513, 613 causes the opposite effect.

FIG. 6*a* illustrates a portion of the first fastening member 1*a* showing in particular the second cam element 6, the respective second tappet 60 and the second elastic means 61. Also shown in FIG. 6*a* is the second preloading device 610. FIG. 6*a* might also be considered as an illustration of the first preloading device 510 which, in the preferred embodiment, has the same components (it is sufficient to substitute the reference numbers in FIG. 6*a* with the corresponding reference numbers of the components of the first preloading device 510, obviously also considering, instead of the second cam element 6, the first cam element 5 which differs from it only in shape which, in this context, is irrelevant in terms of the general structure of the preloading devices 510, 610). The same applies to FIG. 7*a*, where double reference numbers (applying to both the first and the second preloading device 510, 610) are shown.

Advantageously, the pushers 501, 601, helical springs 502, 602, rockers 511, 611 and selectors 513, 613 are accommodated in respective housings formed in the walls of the cavity 14*a* of the first fastening member. More specifically, the helical springs 502, 602, rockers 511, 611 and selectors 513, 613 are accommodated in respective housings formed in a bottom wall 140*a* of the cavity 14*a* of the first fastening member distal from the second fastening member 1*b* when the hinge 1 is in the closed position. In particular, as illustrated in the drawings, the rockers 513, 613 form part of the structure of the bottom wall 140*a*. The selectors 513, 613 may be advantageously accommodated in respective through housings in the bottom wall 140*a*. The tappets 50, 60 (more specifically, the respective pushers 500, 600) and the respective elastic means 51, 61 (more specifically, the helical springs 502, 602) may be accommodated in respective through housings in the bottom wall 140*a*.

Conveniently, the first fastering member 1*a* comprises a first structure 8*a* and at least a second structure 9*a*, which the connecting device 2 is engaged with and which is movable relative to the first structure 8*a* for adjusting its position in the hinge 1. The adjustment is achieved through the agency of respective adjustment means 800 which may be embodied in several different ways all within the knowledge of an expert in the trade. The bottom wall 140*a* of the cavity 14*a* of the first fastening member distal from the second fastening member 1*b* when the hinge 1 is in the closed position is at least partly defined by a bottom wall of the second structure 9*a* (see in particular FIGS. 11 and 6*a*).

Generally speaking, the first and second tappets 50, 60 and the respective first and second elastic means 51, 61 are accommodated in respective housings formed in the walls of the cavity 14*a* of the first fastening member 1*a*.

The invention brings important advantages. The closing device integrated in the hinge 1 is compact and versatile to use. It may be adapted to a multiplicity of situations and allows a desired closing kinematic scheme to be created for the hinge 1 (and for the related door or openable furniture part). It is easy to define neutral zones or points along the opening/closing movement where the door or openable furniture part can remain without closing. It is also easy to make these positions relatively stable if necessary. It is possible to calibrate the closing force selectively in the different angular working fields thanks to the combined action of the shape and angular displacement of the cam elements and, where present, of the action of the preloading devices acting independently on the different tappets which come into contact with the cam elements.

The invention claimed is:

1. A fully concealed hinge (1) for doors or openable furniture parts, comprising a first fastening member and a second fastening member (I*a*;I*b*) configured to be recessed one in a door or openable furniture part and the other in a respective jamb;

each of the first and second fastening members have at least: one respective flat surface portion (10*a*;11*a*;10*b*; 11*b*) lying in a respective plane (12*a*;13*a*;12*b*;13*b*);

the first and second fastening members are connected to each other by a connecting device (2) which allows them to move relative to each other between an open position of the hinge (1), corresponding to a fully open position of the door or openable furniture parts and a closed position of the hinge (1), corresponding to a closed position of the door or openable furniture part and where the plane (12*a*, 13*a*) of the flat surface portion (10*a*, 11*a*) of the first fastening member (1*a*) faces the plane (12*b*, 13*b*) of the flat surface portion (10*b*, 11*b*) of the second fastening member (1b), a cavity (14*a*) of the first fastening member (I*a*) and a cavity (14*b*) of the second fastening member (1*b*) combining, in the closed position, to form a housing for accommodating the connecting device (2);

the connecting device (2) comprising an arm element (20) which rotates about a rotation pin (3) of the first fastening member (1*a*) and whose angle of rotation (ALFA) about the pin (3) adopts a minimum value of zero at the closed position, a maximum value ($ALFA_{13}MAX$) which is not zero at the open position and intermediate values between the minimum and the maximum at intermediate positions between the closed and open positions, the hinge (I) further comprising an automatic closing device (4)

comprising:

at least a first cam element (5) and a second cam element (6), formed on a corresponding first portion (20*a*) and a second portion (20*b*) of the arm element (20), respectively, the first portion (20*a*) and the second portion (20*b*) of the arm element (20) each extending around the rotation pin (3) and being axially spaced along the pin (3);

at least one first tappet (50) biased by first elastic means (51) which keep the at least one first tappet engaged on the first cam element (5);

at least one second tappet (60) biased by second elastic means (61) which keep the at least one second tappet engaged on the second cam element (6);

the at least one first and second tappets (50, 60) and the respective first and second elastic means (51, 61) being located on the first fastening member (I*a*) and being received in the housing formed in combination, when the hinge (1) is in the closed position, by the cavity (I4*a*) of the first fastening member (I*a*) and by the cavity (I4*b*) of the second fastening member (1*b*);

the first cam element (5) comprises a respective active portion (52) with which the at least one first tappet (50) interacts for values of the rotation angle (ALFA) of the arm element (20) falling within a first angular field (I), the second cam element (6) comprising a respective active portion (62) with which the at least one second tappet (60) interacts for values of the rotation angle (ALFA) of the arm element (20) falling within a second angular field (II) which is at least partly not superposed over the first angular field (I);

in the first angular field (I) the rotating of the arm element (20) in a first rotation direction (i) corresponding to an action of the active portion (52) of the first cam element (5) on the at least one first tappet (50) which progressively loads the first elastic means (51), whilst the rotating of the arm element (20) in a second rotation direction (ii) opposite to the first rotation direction corresponds to the progressive releasing of the first elastic means (51) and the consequent action of the at least one first tappet (50) on the active portion (52) of the first cam element (5), thereby causing a relative movement of the first and second fastening members (I*a*, 1*b*) towards the closed position;

in the second angular field (II) the rotating of the arm element (20) in the first rotation direction (i) corresponding to an action of the active portion (62) of the second cam element (6) on the at least one second tappet (60) which progressively loads the second elastic means (61), whilst the rotating of the arm element (20) in the second rotation direction (ii) corresponds to the progressive releasing of the second elastic means (61) and the consequent action of the at least one second tappet (60) on the active portion (62) of the second cam element (6), thereby causing a relative movement of the first and second fastening members (I*a*, 1*b*) towards the closed position.

2. The hinge (1) according to claim 1, characterized in that the first angular field (I) and the second angular field (II) are separate.

3. The hinge (1) according to claim 1, characterized in that:

the first angular field (I) is defined by values of the angle of rotation (ALFA) of the arm element (20) between a first predetermined value (ALFA_1) which is greater than or equal to zero, and a second predetermined value (ALFA_2) which is greater than the first value (ALFA_1), the rotating of the arm element (20) in the first rotation direction (i) increasing the rotation angle (ALFA) in the direction from the first predetermined value (ALFA_1) to the second predetermined value (ALFA_2) and, vice versa, the rotating of the arm element (20) in the second rotation direction (ii) decreasing the rotation angle (ALFA) in the direction from the second predetermined value (ALFA_2) to the first predetermined value (ALFA_I);

the second angular field (II) is defined by values of the angle of rotation (ALFA) of the arm element (20) between a third predetermined value (ALFA_3) which is greater than or equal to zero, and a fourth predetermined value (ALFA_4) which is greater than both the predetermined third value (ALFA_3) and the second predetermined value (ALFA_2), the fourth predetermined value (ALFA_4) being less than the maximum value ($ALFA_{13}$ MAX), the rotating of the arm element (20) in the first rotation direction (i) increasing the rotation angle (ALFA) in the direction from the third predetermined value (ALFA_3) to the fourth predetermined value (ALFA_4) and, vice versa, the rotating of the arm element (20) in the second rotation direction (ii) decreasing the rotation angle (ALFA) in the direction from the fourth predetermined value (ALFA_4) to the third predetermined value (ALFA_3).

4. The hinge (1) according to claim 3, characterized in that the first cam element (5) comprises a first auxiliary portion (53) which follows the active portion (52) in the rotation direction (i) and with which the at least one first tappet (50) comes into contact for values of the rotation angle (ALFA) between the second predetermined value (ALFA_2) and a fifth predetermined value (ALFA_5) less than, or at most equal to, the fourth predetermined value (ALFA_4), during interaction between the auxiliary portion (53) and the at least one first tappet (50), during rotation of the arm element (20) in the first rotation direction (i), the increase in the loading of the first elastic means (51) per rotation angle unit being zero or a value smaller than that which occurs on the active portion (52).

5. The hinge (1) according to claim 3, characterized in that the first cam element (5) and the second cam element (6) each comprise a respective end portion (54, 64), with which the at least one first tappet (50) and the at lest one second tappet (60) come respectively into contact for values of the angle of rotation (ALFA) of the arm element (20) between the fourth predetermined value (ALFA_4) and the maximum value (ALFA_MAX) and on which, during interaction between the at least one first tappet, the at least one second tappet, the first cam element, and the second cam element, the first elastic means (51) and the second elastic means(61), respectively, keep their loading level constant or decrease it for a rotation of the arm element (20) in the first rotation direction (i).

6. The hinge (1) according to claim 3, characterized in that:

the active portion (52) of the first cam element (5) and the active portion (62) of the second cam element (6) are each defined by a respective flat surface (520, 620) parallel to the axis of rotation which is defined by the rotation pin (3) of the arm element (20) and which does not contain that axis, the flat surfaces (520, 620) being inclined to each other at a predetermined angle, (BETA) which is not zero and is less than a right angle;

the at least one first and second tappets (50, 60) each comprise at least one respective pusher (500, 600) movable along an axis (501, 601) which, when the at least one first and second tappet (50, 60) the at least one pusher (500, 600) belongs to is in contact with the respective active portion (52, 62), is transversal to the plane of the respective flat surface (520, 620), the at least one pusher (500, 600) being opposed, in a direction away from the axis of the rotation pin (3), by at least one respective helical spring (502, 602).

7. The hinge (1) according to claim 6, characterized in that the plane in which the flat surface (520) of the active portion (52) of the first cam element (5) lies is obtained from the plane in which the flat surface (620) of the active portion (62) of the second cam element (6) lies by rotating the latter about the axis of the rotation pin (3) of the arm element (20) in the second rotation direction (ii) through an angle equal in value to the difference between the fourth predetermined value (ALFA_4) and the second predetermined value (ALFA_2) of the rotation angle (ALFA) of the arm element (20).

8. The hinge (1) according to claim 6, characterized in that the axis (501) along which the at least one pusher (500) of the at least one first tappet (50) moves and parallel to which the helical spring (502) operates is parallel to the axis (601) along which the at least one pusher (600) of the at least one second tappet (60) moves and parallel to which the helical spring (602) operates.

9. The hinge (1) according to claim 8, characterized in that the plane defined by the axis (501) along which the at least one pusher (500) of the at least one first tappet (50) moves and by the axis (601) along which the at least one pusher (600) of the at least one second tappet (60) moves contains the axis of the rotation pin (3) of the arm element (20).

10. The hinge (1) according to claim 1, characterized in that it comprises:

a first preloading device (510) acting on the first elastic means (51) and able to be set by a user at a predetermined value of minimum contact force between the at least one first tappet (50) and the active portion (52) of the first cam element (50) selectable from a plurality of predetermined minimum values;

a second preloading device (610) acting on the second elastic means (61) and able to be set by the user, independently of the first preloading device (510), at a predetermined value of minimum contact force between the at least one second tappet (60) and the active portion (62) of the second cam element (60) selectable from a plurality of predetermined minimum values.

11. The hinge (1) according to claim 10, characterized in that:

the first angular field (I) is defined by values of the angle of rotation (ALFA) of the arm element (20) between a first predetermined value (ALFA_1) which is greater than or equal to zero, and a second predetermined value (ALFA_2) which is greater than the first value (ALFA_1), the rotating of the arm element (20) in the first rotation direction (i) increasing the rotation angle (ALFA) in the direction from the first predetermined value (ALFA_1) to the second predetermined value (ALFA_2) and, vice versa, the rotating of the arm element (20) in the second rotation direction (ii) decreasing the rotation angle (ALF A) in the direction from the second predetermined value (ALFA_2) to the first predetermined value (ALFA_I);

the second angular field (II) is defined by values of the angle of rotation (ALFA) of the arm element (20) between a third predetermined value (ALFA_3) which is greater than or equal to zero, and a fourth predetermined value (ALFA_4) which is greater than both the predetermined third value (ALFA_3) and the second predetermined value (ALFA_2), the fourth predetermined value (ALFA_4) being less than the maximum value ($ALFA_{13}$ MAX), the rotating of the arm element (20) in the first rotation direction (i) increasing the rotation angle (ALFA) in the direction from the third predetermined value (ALFA_3) to the fourth predetermined value (ALFA_4) and, vice versa, the rotating of the arm element (20) in the second rotation direction (ii) decreasing the rotation angle (ALFA) in the direction from the fourth predetermined value (ALFA_4) to the third predetermined value (ALFA_3);

the active portion (52) of the first cam element (5) and the active portion (62) of the second cam element (6) are each defined by a respective flat surface (520, 620) parallel to the axis of rotation which is defined by the rotation pin (3) of the arm element (20) and which does not contain that axis, the flat surfaces (520, 620) being inclined to each other at a predetermined angle, (BETA) which is not zero and is less than a right angle;

the at least one first and second tappets (50, 60) each comprise at least one respective pusher (500, 600) movable along an axis (501, 601) which, when the tappet (50, 60) the at least one pusher (500, 600) belongs to is in contact with the respective active portion (52, 62), is transversal to the plane of the respective flat surface (520, 620), the at least one pusher (500, 600) being opposed, in a direction away from the axis of the rotation pin (3), by at least one respective helical spring (502, 602);

the axis (501) along which the at least one pusher (500) of the at least one first tappet (50) moves and parallel to which the helical spring (502) operates is parallel to the axis (601) along which the at least one pusher (600) of the at least one second tappet (60) moves and parallel to which the helical spring (602) operates;

the first preloading device (510) and the second preloading device (610) each comprise a respective rocker (511, 611) and a respective selector (513, 613) operating on the rocker (511, 611);

the rocker is pivoted about a respective axis (512, 612) parallel to the axis of the rotation pin (3) of the arm element (20), on one side of its axis (512, 612) the rocker (511, 611) being in contact with the helical spring (502, 602) of the respective elastic means (51, 61) and on the opposite side of its axis (512, 612) the rocker being in contact with the respective selector (513 ,613);

the selector (513, 613) is accessible to the user at least when the hinge (1) is in the open position and selects an angle of rotation of the respective rocker (511, 611) either in the direction in which the respective at least one first and second tappet (50, 60) moves in order to push the respective cam element (5, 6), compressing the helical spring (502, 602) or in the opposite direction to obtain the opposite effect.

12. The hinge (1) according to claim 11, characterized in that the at least one pushers (501, 601), helical springs (502, 602), rockers (511, 611) and selectors (513, 613) are accommodated in respective housings formed in the walls of the cavity (14*a*) of the first fastening member.

13. The hinge (1) according to claim 11, characterized in that the helical springs (502, 602), rockers (511, 611) and selectors (513, 613) are accommodated in respective housings formed in a bottom wall (140*a*) of the cavity (14*a*) of the first fastening member distal from the second fastening member (1*b*) when the hinge (1) is in the closed position.

14. The hinge (1) according to claim 13, characterized in that the first fastening member (1*a*) comprises a first structure (8*a*) and at least a second structure (9*a*) which the connecting device (2) is engaged with and which is movable relative to the first structure (8*a*) for adjusting its position in the hinge (1), the bottom wall (140*a*) of the cavity (14*a*) of the first fastening member distal from the second fastening member (1*b*) when the hinge (1) is in the closed position being at least partly defined by a bottom wall of the second structure (9*a*).

15. The hinge (1) according to claim 1, characterized in that the at least one first and second tappets (50, 60) and the respective first and second elastic means (51, 61) are accommodated in respective housings formed in the walls of the cavity (14*a*) of the first fastening member (1*a*).

* * * * *

UNITED STATES PATENT AND TRADEMARK OFFICE

CERTIFICATE OF CORRECTION

PATENT NO. : 8,650,713 B2
APPLICATION NO. : 13/596167
DATED : February 18, 2014
INVENTOR(S) : Massimo Migliorini It is certified that error appears in the above-identified patent and that said Letters Patent is hereby corrected as shown below:

In the Claims:

In column number 15, line number 54, in line 28 of Claim 1,
please delete: "ALFA13MAX" and insert therefor --ALFA__MAX--.

In column number 17, line number 9, in line 24 of Claim 3,
please delete: "ALFA13MAX" and insert therefor --ALFA__MAX--.

In column number 18, line number 59, in line 25 of Claim 11,
please delete: "ALFA13MAX" and insert therefor --ALFA__MAX--.

Signed and Sealed this
Tenth Day of June, 2014

Michelle K. Lee

Michelle K. Lee
*Deputy Director of the United States Patent and Trademark Office*